US009525253B2

(12) United States Patent
Cheong Wai Luen

(10) Patent No.: US 9,525,253 B2
(45) Date of Patent: Dec. 20, 2016

(54) SOCKET, A PLUG, AN ASSEMBLY, A METHOD OF SETTING A SOCKET AND A METHOD OF RESETTING A SOCKET

(71) Applicant: SCHNEIDER ELECTRIC INDUSTRIES SAS, Rueil-Malmaison (FR)

(72) Inventor: Eugene Cheong Wai Luen, Choa Chu Kang Central (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 91 days.

(21) Appl. No.: 14/554,476

(22) Filed: Nov. 26, 2014

(65) Prior Publication Data

US 2015/0147899 A1 May 28, 2015

(30) Foreign Application Priority Data

Nov. 26, 2013 (SG) ..... 201308762-2

(51) Int. Cl.
*H01R 13/64* (2006.01)
*H01R 27/00* (2006.01)
*H01R 13/645* (2006.01)

(52) U.S. Cl.
CPC ..... *H01R 27/00* (2013.01); *H01R 13/645* (2013.01)

(58) Field of Classification Search
CPC ..... H01R 13/64
USPC ..... 439/681
See application file for complete search history.

(56) References Cited

U.S. PATENT DOCUMENTS 3,971,609 A * 7/1976 Knecht ..... H01R 13/652 439/102
4,386,333 A * 5/1983 Dillan ..... H01F 29/00 323/328

* cited by examiner

*Primary Examiner* — Tho D Ta
(74) *Attorney, Agent, or Firm* — Lando & Anastasi, LLP

(57) ABSTRACT

There is provided a socket for selectively coupling to a plug. The socket comprising a conforming portion adapted to conform to a first configuration complementary to the plug, wherein the first configuration allows the socket to electrically couple to the plug; and a securing member adjustable to releasably engage at least part of the conforming portion to substantially prevent the conforming portion from changing to a second configuration different from the first configuration, wherein the second configuration substantially prevents the socket from electrically coupling to the plug. There are also provided a plug configured to cooperate with the socket, a plug and socket assembly, a method of setting the socket for selectively coupling to the plug, and a method of resetting the socket programmed to selectively coupling to the plug.

23 Claims, 17 Drawing Sheets

SOCKET, A PLUG, AN ASSEMBLY, A METHOD OF SETTING A SOCKET AND A METHOD OF RESETTING A SOCKET

CROSS REFERENCE TO RELATED APPLICATION

This application claims the benefit under 35 U.S.C. §119 of Singapore Patent Application No. 201308762-2 filed on Nov. 26, 2013 which is hereby incorporated herein by reference in its entirety for all purposes.

TECHNICAL FIELD

Various embodiments relate to sockets, plugs, socket and plug assemblies, methods of setting sockets and methods of resetting sockets.

BACKGROUND

In electrical systems, plugs and sockets are typically used for providing electrical connectivity between devices. For purposes of cost effective mass manufacturing and flexibility in design, etc., plugs may be produced with common or similar structures, but may be used for different set-ups (for example, having different voltage rating configurations) of an electrical system. Likewise, sockets used for a particular set-up may also be structurally similar to sockets used for a different set-up.

Due to possible confusion caused by using commonly-structured or similarly-structured plugs and/or sockets, attempts have been made to ensure that a compatible plug is coupled to the correct socket. Such attempts include visual indications as exemplified in labeling and colour coding.

For example, relay plugs or plug-in relays currently available in the market have indications of voltage rating configurations printed on their housings, or have coloured pushbuttons installed thereon for visual indications on the different types of the relay plugs or plug-in relays. However, no corresponding indications are provided on the relay sockets receiving these relays. A relay socket, unlike a relay plug or a plug-in relay, typically does not carry any permanent indications of its voltage rating configuration because the relay socket is used for connecting to different set-ups for the controlling circuit and/or the controlled circuit and would therefore be subject to a voltage rating configuration that is dependent on each set-up.

The absence of any indication on the relay socket on the specific voltage rating configurations may prove difficult for users to easily, quickly and accurately identify the matching relay plug or plug-in relay for the specific relay socket. As a result, a high possibility of relay plug and socket mismatch exists. An incompatible relay plug or plug-in relay connected to an incorrect relay socket may lead to adverse consequences such as circuit malfunction or overloading which may cause the misoperation of the relay and/or eventually, to the failure of the circuits in the electrical system. Thus, it is important that the relay is of an appropriate voltage rating configuration for use in a set-up of the controlling circuit and the controlled circuit.

Providing visual indications and coloured pushbuttons for labelling the relay plugs to their specific voltage configuration is also not adequately effective in preventing or at substantially reducing the likelihood of a relay socket and relay plug or plug-in relay mismatch since oversight may still occur frequently.

Further, preparation or initialization of visual indications and colour pushbuttons may be cumbersome and time-consuming in that users, especially new users, may be unfamiliar with which indications are meant for which set-ups and may have to refer to guidelines or manuals in order for them to confirm how to proceed with the preparation or initialization of the indications.

In view of the above, there is a need to provide a socket, a plug, and a plug and socket assembly that address or at least ameliorate the above drawbacks, and improve usability.

SUMMARY

According to one aspect, there is provided a socket for selectively coupling to a plug, the socket comprising a conforming portion adapted to conform to a first configuration complementary to the plug, wherein the first configuration allows the socket to electrically couple to the plug; and a securing member adjustable to releasably engage at least part of the conforming portion to substantially prevent the conforming portion from changing to a second configuration different from the first configuration, wherein the second configuration substantially prevents the socket from electrically coupling to the plug.

In various embodiments, the conforming portion is adapted to conform to the first configuration upon coupling with the plug.

In one embodiment, the socket comprises a memory feature whereby the securing member engages at least part of the conforming portion so that the conforming portion retains the first configuration upon decoupling of the plug.

In various embodiments, the conforming portion is electrically non-conductive.

In various embodiments, the first configuration is complementary to a first identifier member disposed on the plug.

In one embodiment, the first configuration comprises a configuration that is complementary to at least one of a structure or an orientation of the first identifier member.

In various embodiments, the second configuration is complementary to a second identifier member disposed on a different plug, the first and second identifier members having at least one characteristic that is different from each other.

In one embodiment, the second configuration comprises a configuration complementary to at least one of a structure or an orientation of the second identifier member.

In various embodiments, the securing member is configured to move between a locked position and an unlocked position, wherein in the locked position, the securing member engages the at least part of the conforming portion; and wherein in the unlocked position, the securing member is substantially free from being engaged with the at least part of the conforming portion.

In one embodiment, the socket further comprises a guide for guiding the movement of the securing member between the locked position and the unlocked position.

In various embodiments, the socket further comprises a biasing member arranged to bias the securing member against the conforming portion.

In one embodiment, the biasing member comprises a spring.

In various embodiments, the conforming portion comprises a plurality of structural elements independently movable with respect to each other for allowing the conforming portion to conform to the first configuration.

In various embodiments, the first configuration comprises a surface configuration of the socket defined by the conforming portion.

In various embodiments, each of the plurality of structural elements comprises an elongated member.

In various embodiments, at least one of the plurality of structural elements coupled to a returning member for returning the structural element to a resting position when the securing member is substantially disengaged from the conforming portion.

In one embodiment, the resting position comprises a position where the structural element extends from a surface of the socket.

In various embodiments, the securing member is adjustable to engage at least one of the plurality of structural elements.

In one embodiment, the at least one of the plurality of structural elements comprises at least one detent configured to cooperate with the securing member.

In one embodiment, the securing member comprises at least one projection; and wherein the at least one detent is arranged to receive the at least one projection such that the at least one of the plurality of structural elements is prevented from being movable.

In various embodiments, the socket further comprises a resetting member coupled to the securing member, wherein the resetting member is operable to release engagement of the securing member with the at least part of the conforming portion to allow the conforming portion to be free to conform to a new configuration.

In various embodiments, the socket is a relay socket.

In various embodiments, the plug is a relay plug.

In various embodiments, the conforming portion in the first configuration is associated with a voltage rating configuration of the plug and is incompatible to couple to another plug having a different voltage rating configuration.

In various embodiments, the first identifier member is associated with a first voltage rating configuration that is different from a second voltage rating configuration associated with the second identifier member.

In various embodiments, the conforming portion is disposed on a housing of the socket.

According to another aspect, there is provided a socket housing for a socket according to various embodiments as described herein.

According to yet another aspect, there is provided a plug configured to cooperate with a socket according to various embodiments as described herein, the plug comprising an identifier member that is complementary to the first configuration of the socket such that the plug is capable of electrically coupling to the socket when the conforming portion of the socket is in the first configuration.

In various embodiments, the identifier member is capable of adapting the conforming portion of the socket according to various embodiments as described herein to conform to the first configuration.

In various embodiments, the plug further comprises a switching module configured to perform electrical switching for an electric circuit.

According to another aspect, there is provided a plug and socket assembly comprising a socket according to various embodiments as described herein; and a plug according to various embodiments as described herein electrically coupled to the socket.

In various embodiments, the plug and socket assembly is a relay plug and relay socket assembly.

According to another aspect, there is provided a method of setting a socket for selectively coupling to a plug, the method comprising providing the socket comprising a conforming portion thereon, the conforming portion capable of conforming to a first configuration complementary to the plug; and a securing member adjustable to releasably engage at least part of the conforming portion; conforming the conforming portion to the first configuration complementary to the plug wherein the first configuration allows the socket to electrically couple to the plug; and engaging the securing member with the at least part of the conforming portion to substantially prevent the conforming portion from changing to a second configuration different from the first configuration, wherein the second configuration substantially prevents the socket from electrically coupling to the plug.

In various embodiments, the step of conforming the conforming portion to the first configuration comprises coupling the socket with the plug.

In various embodiments, the step of engaging the securing member comprises moving the securing member from an unlocked position to a locked position, wherein in the locked position, the securing member engages the at least part of the conforming portion and wherein in the unlocked position, the securing member is substantially free from being engaged with the at least part of the conforming portion.

In various embodiments, the conforming portion comprises a plurality of structural elements independently movable with respect to each other for allowing the conforming portion to conform to the first configuration.

In various embodiments, the step of engaging the securing member to the at least part of the conforming portion comprises receiving at least one projection of the securing member in at least one detent disposed on at least one of the plurality of structural elements such that the at least one of the plurality of structural elements is substantially prevented from moving with respect to another structural element.

According to yet another aspect, there is provided a method of resetting a socket programmed to selectively coupling to a plug, the method comprising providing the socket comprising a conforming portion in a first configuration complementary to the plug, wherein the first configuration allows the socket to electrically couple to the plug; and a securing member in engagement with at least part of the conforming portion such that the conforming portion is substantially prevented from changing to a second configuration different from the first configuration, wherein the second configuration substantially prevents the socket from electrically coupling to the plug; disengaging the securing member from the at least part of the conforming portion such that the conforming portion is no longer prevented from changing to the second configuration different from the first configuration.

In various embodiments, the method further comprises moving the securing member from a locked position to an unlocked position, wherein in the locked position, the securing member engages with the at least part of the conforming portion and wherein in the unlocked position, the securing member is substantially free from being engaged with the at least part of the conforming portion.

In various embodiments, the conforming portion comprises a plurality of structural elements independently movable with respect to each other for allowing the conforming portion to conform to the first configuration, and wherein at least one of the plurality of structural elements coupled to a biasing member for returning the structural element to a resting position when the securing member is in the unlocked position.

In one embodiment, the step of disengaging the securing member from the at least part of the conforming portion is carried out when a plug is not coupled to the socket.

In various embodiments, the socket is a relay socket.

In various embodiments, the plug is a relay plug.

The term "relay" as used herein broadly refers to an electrically operated switch that is positioned within an electric circuit, and has an open state to cut off current from flowing through the circuit, and a closed state to allow current to flow through the circuit.

The terms "relay socket", "relay plug" and "relay plug and relay socket assembly" are to be construed accordingly.

The term "relay plug" may be used interchangeably with the term "plug-in relay" disclosed herein.

The terms "coupled" or "connected" as used in this description are intended to cover both directly connected or connected through one or more intermediate means, unless otherwise stated.

The term "conform" when used herein is to be interpreted broadly to mean the act of complying, bringing into harmony or in agreement. For example, when an object is described to confirm to a shape or configuration, the object may experience a change to be in compliance or harmony with the shape or configuration. The change may be, but is not limited to, a physical change such as a change in orientation, structure, shape, size, etc.

The term "associated with" as used herein generally means having a relationship with. In the context of various example embodiments, an identifier member (for example, of a plug) being associated with a voltage rating configuration of a plug may refer to the identifier member being representative of or unique to a plug having a particular voltage rating configuration. For example, a relay plug having a 220V voltage rating configuration may be but is not limited to being associated with a substantially squarish configuration for the identifier member, while in another example, a relay plug having a 120 voltage rating configuration may be but is not limited to being associated with a substantially hexagonal configuration for the identifier member. In the context of various embodiments, an identifier member (for example, of a plug) being associated with a particular voltage rating configuration may refer to the identifier member being complementary to a configuration of the socket such that the socket is capable of coupling with the plug having that particular voltage rating configuration. Based on the above example, for the relay plug having a 220V voltage rating configuration, the identifier member may be complementary to a substantially squarish configuration of the relay socket, while in the other example, for the relay plug having a 120 V voltage rating configuration, the identifier member may be complementary to a substantially hexagonal configuration of the relay socket. Thus, in these examples, the identifier member may also be visually representative of the particular voltage rating configuration it is associated with.

The term "substantially cylindrical" when used herein to describe an object (e.g., at least one of a plurality of elements of the conforming portion) is to be interpreted broadly to mean that the object is elongate along a longitudinal axis and has a cross-section (along a lateral axis) that is substantially a circle, or an ellipse, or a part thereof. In some examples, the object that is substantially cylindrical has a cross-section that has a peripheral that is a part (e.g. 60% or more, 65% or more, 70% or more, 75% or more, 85% or more, 90% or more, or 95% or more) of a circle or an ellipse. In one example, the object that is substantially cylindrical has a cross-section that has a peripheral that is 80% or more of a circle or an ellipse.

The term "substantially cubodial" when used herein to describe an object (e.g., at least one of a plurality of elements of the conforming portion) is to be interpreted broadly to mean that the object is elongate along a longitudinal axis and has a cross-section (along a lateral axis) that is substantially a square, or a rectangle, or a part thereof. In some examples, the object that is substantially cubodial has a cross-section that has a peripheral that is a part (e.g. 60% or more, 65% or more, 70% or more, 75% or more, 85% or more, 90% or more, or 95% or more) of a square or a rectangle. In one example, the object that is substantially cubodial has a cross-section that has a peripheral that is 80% or more of a square or a rectangle.

The term "operable" or "operably" used herein when referring to a resetting member may generally refer to the resetting member being controlled by a user.

As used herein, the term "activating" as used herein is to be interpreted broadly to mean working, operating, triggering, controlling, or the like.

The term "adjacent" used herein when referring to two elements refers to one element being in close proximity to another element and may be but is not limited to the elements contacting each other or may further include the elements being separated by one or more further elements disposed therebetween.

The term "and/or", e.g., "X and/or Y" is understood to mean either "X and Y" or "X or Y" and should be taken to provide explicit support for both meanings or for either meaning.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

Additionally, when describing some embodiments, the disclosure may have disclosed a method and/or process as a particular sequence of steps. However, unless otherwise required, it will be appreciated that the method or process should not be limited to the particular sequence of steps disclosed. Other sequences of steps may be possible. The particular order of the steps disclosed herein should not be construed as undue limitations. Unless otherwise required, a method and/or process disclosed herein should not be limited to the steps being carried out in the order written. The sequence of steps may be varied and still remain within the scope of the disclosure.

Exemplary, non-limiting embodiments of a socket, a plug, a socket and plug assembly, a method of setting a socket and a method of resetting a socket are disclosed hereinafter.

There is provided a socket for selectively coupling to a plug. The socket may comprise a conforming portion adapted to conform to a first configuration complementary to the plug, wherein the first configuration allows the socket to electrically couple to the plug; and a securing member adjustable to releasably engage at least part of the conforming portion to substantially prevent the conforming portion from changing to a second configuration different from the first configuration, wherein the second configuration substantially prevents the socket from electrically coupling to the plug. When the socket is conformed to the first configuration, the complementary plug may couple to the socket while a non-complementary plug may not couple to the socket. Complementary plugs may, for example, refer to plugs having the same or compatible voltage rating configuration. The socket conformed and secured to the first configuration may provide an advantageous memory feature which enables coupling to a first complementary plug and subsequently with the first complementary plug removed from the socket, a second complementary plug may be coupled to the socket, while substantially preventing a third non-complementary plug from being coupled to the socket, therefore allowing socket-plug mismatches to be minimized or avoided.

For example, a foolproof relay socket with memory effect, to avoid replacement mismatch for relay plugs or plug-in relays may be provided.

In one embodiment, the conforming portion is adapted to conform to the first configuration upon coupling with the plug. Advantageously, a user may choose to obtain a desired complementary plug to couple to the socket so as to set to the first configuration without a need to refer to any coding manuals to set the first configuration manually.

In one embodiment, the socket comprises a memory feature whereby the securing member engages at least part of the conforming portion so that the conforming portion retains the first configuration upon decoupling of the plug. For example, upon coupling with the plug, the conforming portion of the socket may conform to the first configuration. Upon removing or decoupling the plug from the socket, the first configuration of the socket may be retained. The socket therefore advantageously may include the memory feature.

In various embodiments, the conforming portion is electrically non-conductive. For example, the conforming portion may be made of a polymer such as rubber or plastic, or other resilient materials. This may be beneficial in reducing manufacturing costs, in increasing aesthetic appeal and/or, to some extent, for electrical safety purposes.

In various embodiments, the first configuration comprises a surface configuration (or contour) of the socket defined by the conforming portion.

In various embodiments, the first configuration is complementary to a first identifier member disposed on the plug. The first identifier member may be disposed on a surface of the plug where the surface of the first identifier member abuts a surface of the socket. Thus, in various embodiments, in the first configuration, the conforming portion mates with the first identifier member in a complementary manner. In one example, the plug may be a plug known in the art and does not have an identifier member. In such a case, the first configuration is complementary to the surface of the plug known in the art. In other words, in some embodiments, the socket may also allow plugs without identifier members to plug in. Advantageously, third party plugs without identifier members may be used together with the socket in accordance with various embodiments.

In one embodiment, the first configuration comprises a configuration that is complementary to at least one of a structure or an orientation of the first identifier member. The structure or the orientation may complement, for example, a peripheral surface of the conforming portion. In some examples, the orientation of the first identifier member may also refer to a position of the first identifier member.

In various embodiments, the second configuration is complementary to a second identifier member disposed on a different plug, the first and second identifier members having at least one characteristic that is different from each other. The different plug may be referred to as a non-complementary plug and thus the second identifier member is different from the first identifier member. For example, the second configuration may comprise a configuration complementary to at least one of a structure or an orientation of the second identifier member. The structure or the orientation may complement, for example, the peripheral surface of the conforming portion. In some examples, the orientation of the second identifier member may also refer to a position of the second identifier member.

In various embodiments, the securing member is configured to move between a locked position and an unlocked position, wherein in the locked position, the securing member engages the at least part (or all) of the conforming portion; and wherein in the unlocked position, the securing member is substantially free from being engaged with the at least part (or all) of the conforming portion. In the locked position, with the securing member being engaged to the at least part (or all) of the conforming portion, the conforming portion may be set or locked in to the first configuration and may not change to a different (new) configuration. In the unlocked position, with the securing member being substantially free from being engaged with the at least part (or all) of the conforming portion, the conforming portion may not be locked in to any configuration and may therefore change to a different (new) configuration to be set to.

In one embodiment, the socket further comprises a guide for guiding the movement of the securing member between the locked position and the unlocked position. For example, the guide may be two parallel rails on which the securing member is movable. The guide may advantageously allow the securing member to move between the locked position and the unlocked position more quickly and smoothly. The guide may also provide proper alignment to enable the securing member to accurately engage the conforming portion and may consequently reduce misalignment and collision of the securing member against the conforming portion that may cause wear and tear to these components.

In various embodiments, the socket further comprises a biasing member arranged to bias the securing member against the conforming portion. In one embodiment, the biasing member may be a spring. For example, when the securing member is in the unlocked position, the securing member may be urged against a wall of the conforming portion in response to a biasing force of the biasing member, preventing engagement of the securing member with the conforming portion. When the conforming portion changes to conform to a configuration (e.g., the first configuration), the conforming portion may move relative to the securing member to expose a detent of the conforming portion, such that the detent receives the securing member that is urged forward by the biasing member. This way, engagement between the conforming portion and the securing member may be achieved. The detent may be formed on part of the wall of the conforming portion or the wall of the conforming portion (in a form of a sleeve of the conforming portion) may be arranged between the detent and the securing member.

In various embodiments, the conforming portion comprises a plurality of structural elements independently movable with respect to each other for allowing the conforming portion to conform to the first configuration. For example, for the plurality of structural elements, each structural element may be adjacent to a neighbouring structural element. For example, the spacing between each structural element and its neighbouring structural element may be less than 1 mm apart, less than 2 mm apart, less than 3 mm apart, less than 4 mm apart, less than 5 mm apart, less than 6 mm apart, less than 7 mm apart, less than 8 mm apart, less than 9 mm apart, less than 10 mm apart, less than 20 mm apart, less than 30 mm apart, less than 40 mm apart, or less than 50 mm apart.

In one example, each structural element may have dimensions of about 1.8 mm (length) by about 5 mm (width) by about 10 mm (height).

In one embodiment, each of the plurality of structural elements comprises an elongated member. In various examples, the structural element may be a substantially cylindrical element or a substantially cuboidal element. For example, the structural element may be, but is not limited to a pushbutton or a spring-return pushbutton.

In various embodiments, at least one of the plurality of structural elements coupled to a returning member for example in the form of another biasing member for returning the structural element to a resting position when the securing member is substantially disengaged from the conforming portion.

In one embodiment, the resting position comprises a position where the structural element extends from a surface of the socket. For example, in the resting position, the structural element (e.g. the pushbutton) may be extended from the surface of the socket. This may be opposed to not being in the resting position where the structural element (e.g. the pushbutton) may be depressed onto the surface of the socket. In one example, the first configuration may comprise a level/flat surface configuration when each of the plurality of the structural elements extended at substantially equal distance from the surface of the socket.

In one embodiment, the securing member is adjustable to engage at least one of the plurality of structural elements. In one example, the securing member may be adjustable to engage all of the plurality of structural elements. For example, the securing member may be biasable to engage at least one or all of the plurality of structural elements.

In one embodiment, the at least one of the plurality of structural elements comprises at least one detent configured to cooperate with the securing member.

In one embodiment, the securing member comprises at least one projection; and wherein the at least one detent is arranged to receive the at least one projection such that the at least one of the plurality of structural elements is substantially prevented from moving (or adjusted).

For example, the at least one detent may be at least one recess formed on the conforming portion or on the structural element. For example, the recess may be formed by providing ring structures surrounding parts of the conforming portion/structural element and having these ring structures spaced apart from one another to form the detent(s) therebetween. For example, two or more ring structures may be used. A ring structure may be, for example, a threaded assembly.

In various embodiments, the socket further comprises a resetting member coupled to the securing member, wherein the resetting member is operable to release engagement of the securing member with the at least part of the conforming portion to allow the conforming portion to be free to conform to a new configuration. For example, the resetting member may be coupled to the securing member via the biasing member providing the biasing force to the securing member against the conforming portion. In this example, by operating the resetting member, the biasing member together with the securing member may be withdrawn from urging against the conforming portion, thereby allowing the securing member to move from the locked position to the unlocked position. Subsequently, with the securing member disengaged from the conforming portion, the conforming portion may be able to move relative to the securing member such that the detent of the conforming portion may be no longer be exposed and the securing member in the unlocked position is then urged against the wall of the conforming portion.

In some examples, the socket may further comprise a slot configured to receive the resetting member. The resetting member may be movable along the slot.

In some examples, the socket may include securing members, which may be of similar or different forms from one another to provide engagement with the plurality of structural elements. For example, each structural element may have a dedicated securing member. In one example, the securing members may be ganged or simultaneously controlled. In another example, the securing members may be independently controlled. The securing member(s) may be located at different positions with respect to the structural elements. In other examples, a single securing member may be capable of engaging a plurality of structural elements.

In various embodiments, the socket is a relay socket.

In various embodiments, the plug is a relay plug.

In various embodiments, when in use, the conforming portion in the first configuration is capable of allowing the socket to electrically couple with the plug having a compatible voltage rating configuration.

In one embodiment, when in use, the conforming portion in the first configuration is capable of preventing the socket to electrically couple with a different plug having a non-compatible voltage rating configuration that is non-compatible with the electrical circuit that the socket is coupled to. For example, the first identifier member may be associated with a first voltage rating configuration that is different from a second voltage rating configuration associated with the second identifier member, the first voltage rating configuration being a compatible voltage rating configuration to the electrical circuit that the socket is coupled to and the second voltage rating configuration being a non-compatible voltage rating configuration to the electrical circuit that the socket is coupled to.

In one embodiment, the conforming portion in the first configuration is associated with a voltage rating configuration of the plug and is incompatible to couple to another plug having a different voltage rating configuration.

In one embodiment, the conforming portion in the first configuration of the socket is associated with a specific voltage rating configuration of a plug and is not capable of coupling complementarily to another plug having a different voltage rating configuration.

In various embodiments, the conforming portion is disposed on a housing of the socket. For example, the housing of the socket may be referred to as an enclosure of the socket.

Various embodiments provide a socket housing for the socket described herein.

In some embodiments, the socket housing comprises cutouts to house the protrusion of the socket to allow the protrusion to extend from the surface of the socket housing.

Various embodiments provide a plug configured to cooperate with the socket described herein, the plug comprising an identifier member that is complementary to the first configuration of the socket such that the plug is capable of electrically coupling to the socket when the conforming portion of the socket is in the first configuration. For example, the identifier member may be described in the context of the first identifier member.

In accordance with one embodiment of the plug described herein, the identifier member is capable of adapting the conforming portion of the socket described herein to conform to the first configuration. For example, the identifier member may be capable of setting/orientating the conforming portion of the socket described herein to conform to the first configuration complementary to the identifier member's configuration.

In various embodiments, the plug is a relay plug and the relay plug further comprises a switching module configured to perform electrical switching for an electric circuit. The switching module may refer to at least a part of the relay and may include an activation part and a switchable part. For example, in a mechanical relay, the activation part may refer to an electromagnetic coil and the switchable part may refer to an armature which is movable in the presence of an electromagnetic field of the electromagnetic coil. In another example, the activation part of an optical relay may refer to an optocoupler and the switchable part may refer to a photodiode which is activated based on a light signal received from the optocoupler. In yet another example of a semiconductor-based relay, the activation part and the switchable part may be realized by a solid-state switching device such as a thyristor activated by a controlled signal.

For example, the plug may be a plug-in relay.

Various embodiments provide a plug and socket assembly comprising the socket and the plug described herein for electrically coupling to the socket.

In one embodiment, the plug and socket assembly is a relay plug and relay socket assembly.

Various embodiments provide a method of setting a socket for selectively coupling to a plug, the method comprising providing: the socket comprising a conforming portion thereon, the conforming portion capable of conforming to a first configuration complementary to the plug; and a securing member adjustable to releasably engage at least part of the conforming portion; conforming the conforming portion to the first configuration complementary to the plug wherein the first configuration allows the socket to electrically couple to the plug; and engaging the securing member with the at least part of the conforming portion to substantially prevent the conforming portion from changing to a second configuration different from the first configuration, wherein the second configuration substantially prevents the socket from electrically coupling to the plug.

The terms "socket", "plug", "conforming portion", "conforming", "first configuration", "securing member", and "second configuration" may have one or more characteristics discussed above.

In accordance with one embodiment of the method of setting the relay socket described herein, the step of conforming the conforming portion to the first configuration comprises coupling the socket with the plug.

In accordance with various embodiments of the method of setting the socket described herein, the step of engaging the securing member comprises moving the securing member from an unlocked position to a locked position, wherein in the locked position, the securing member engages the at least part (or all) of the conforming portion and wherein in the unlocked position, the securing member is substantially free from being engaged with the at least part (or all) of the conforming portion.

For example, the method may further comprise biasing the securing member against the conforming portion.

In accordance with various embodiments of the method of setting the socket described herein, the conforming portion comprises a plurality of structural elements independently movable with respect to each other for allowing the conforming portion to conform to the first configuration.

The term "structural element" may have one or more characteristics discussed above.

In accordance with various embodiments of the method of setting the socket described herein, the step of engaging the securing member to the at least part of the conforming portion comprises receiving at least one projection of the securing member in at least one detent disposed on at least one of the plurality of structural elements such that the at least one of the plurality of structural elements is substantially prevented from moving with respect to another structural element.

The term "detent" may have one or more characteristics discussed above.

Various embodiments provide a method of resetting a socket programmed to selectively coupling to a plug, the method comprising providing the socket comprising: a conforming portion in a first configuration complementary to the plug, wherein the first configuration allows the socket to electrically couple to the plug; and a securing member in engagement with at least part of the conforming portion such that the conforming portion is substantially prevented from changing to a second configuration different from the first configuration, wherein the second configuration substantially prevents the socket from electrically coupling to the plug; disengaging the securing member from the at least part of the conforming portion such that the conforming portion is no longer prevented from changing to the second configuration different from the first configuration.

The terms "socket", "plug", "conforming portion", "first configuration", "securing member", and "second configuration" may have one or more characteristics discussed above.

For example, the socket programmed to selectively coupling to the plug may refer to the socket described herein, which can be set in a manner so as to selectively coupling to the plug.

In accordance with one embodiment of the method of resetting the socket described herein, the method further comprises moving the securing member from a locked position to an unlocked position, wherein in the locked position, the securing member engages with the at least part (or all) of the conforming portion and wherein in the unlocked position, the securing member is substantially free from being engaged with the at least part (or all) of the conforming portion.

In accordance with various embodiments of the methods described herein, the conforming portion comprises a plurality of structural elements independently movable with respect to each other for allowing the conforming portion to conform to the first configuration, and wherein at least one of the plurality of structural elements coupled to a biasing member for returning the structural elements to a resting position when the securing member is in the unlocked position. For example, for the plurality of structural elements, each structural element may be adjacent to a neighbouring structural element.

The terms "biasing member", and "structural element" may have one or more characteristics discussed above.

In accordance with various embodiments of the methods described herein, the step of disengaging the securing member from the at least part of the conforming portion is carried out when a plug is not coupled to the socket. When the plug is not coupled to the socket, a resetting member as described herein may become accessible to a user to operate for performing the step of disengaging the securing member from the at least part of the conforming portion.

In accordance with various embodiments of the methods described herein, the socket is a relay socket.

In accordance with various embodiments of the methods described herein, the plug is a relay plug.

For example, the plug may be a plug-in relay.

In one example, the step of disengaging the securing member from the at least part of the conforming portion may include moving the resetting member along a slot of the socket.

In another example, the step of disengaging the securing member from the at least part of the conforming portion comprises disengaging a received projection of the securing member from at least one detent disposed on at least one of the plurality of structural elements, such that the at least one of the plurality of structural elements is free to move.

For the method of setting the socket or for the method of resetting the socket, each of the plurality of structural elements may comprise an elongated member. In various examples, the structural element may be a substantially cylindrical element or a substantially cuboidal element. For example, the structural element may be, but is not limited to a pushbutton or a spring-return pushbutton.

In some embodiments, the securing member is not a stationary member or not a non-movable member. The securing member may be capable of being actuated to engage one or more structural elements. The securing member may be different from a single latching mechanism, for example, a teethed structure for manually moving a structural element and latching it on the teethed structure without active movement of the teethed structure.

In one embodiment, engagement of the securing member with one or more structural elements comprises movement of both the one or more structural elements and the securing member.

In some embodiments, the one or more structural elements are not translatable substantially along the surface plane of the socket.

In some embodiments, the one or more structural elements are movable in a direction substantially perpendicular to the surface plane of the socket.

In some embodiments, the securing member is internal to the socket such that it is not visible from the external appearance of the socket.

For example, the first configuration may be complementary to a first identifier member disposed on the plug. The first identifier member may be disposed on a surface of the plug where the surface of the first identifier member abuts a surface of the socket.

For example, the first configuration may comprise a configuration that is complementary to at least one of a structure or an orientation of the first identifier member. The structure or the orientation may complement, for example, a peripheral surface of the conforming portion. In some examples, the orientation of the first identifier member may also refer to a position of the first identifier member. When conformed to the first configuration, the socket being incompatible into the second configuration may be caused by physical or mechanical obstructions.

For example, the second configuration may be complementary to a second identifier member disposed on a different plug. The different plug may be referred to as a non-complementary plug and thus the second identifier member is different from the first identifier member. For example, the second configuration may comprise a configuration complementary to at least one of a structure or an orientation of the second identifier member. The structure or the orientation may complement, for example, the peripheral surface of the conforming portion. In some examples, the orientation of the second identifier member may also refer to a position of the second identifier member.

For example, when in use, the conforming portion in the first configuration may be capable of allowing the socket to electrically couple with the plug having a compatible voltage rating configuration.

For example, when in use, the conforming portion in the first configuration may be capable of preventing the socket to electrically couple with a different plug having a non-compatible voltage rating configuration. For example, the first identifier member may be associated with a first voltage rating configuration that is compatible to the first configuration of the socket, therefore allowing the socket in the first configuration to electrically couple with the plug having the first voltage rating configuration. The second identifier member may be associated with a second voltage rating configuration that is not compatible to the first configuration of the socket, therefore preventing the socket in the first configuration to electrically couple with the plug having the second voltage rating configuration.

For example, the conforming portion may be disposed on a socket housing of the socket.

DETAILED DESCRIPTION

Example embodiments of the disclosure will be better understood and readily apparent to one of ordinary skill in the art from the following discussions and if applicable, in conjunction with the figures. It should be appreciated that other modifications related to structural, electrical and optical changes may be made without deviating from the scope of the invention. Example embodiments are not necessarily mutually exclusive as some may be combined with one or more embodiments to form new exemplary embodiments.

Figure 1:
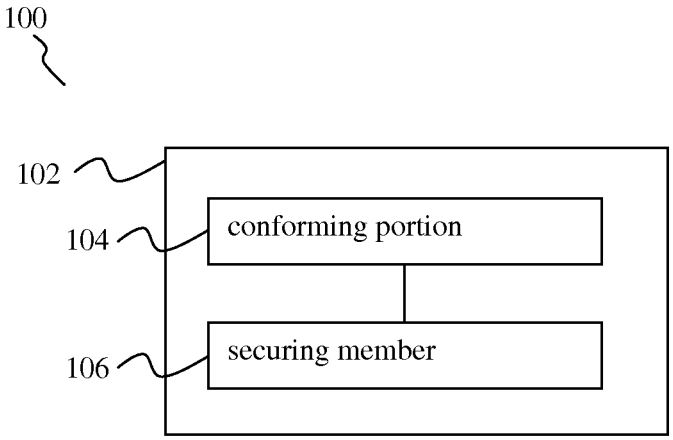
FIG. 1 is a block diagram of a socket, in accordance with various embodiments.

FIG. 1 shows a block diagram 100 of a socket 102 in accordance with various embodiments disclosed herein. In FIG. 1, the socket 102 includes a conforming portion 104 and a securing member 106. The conforming portion 104 may be adapted to conform to a first configuration complementary to a plug (not shown in FIG. 1), wherein the first configuration allows the socket 102 to electrically couple to the plug. The securing member 106 may be adjustable to releasably engage at least part of the conforming portion 104 to substantially prevent the conforming portion 104 from changing to a second configuration different from the first configuration, wherein the second configuration substantially prevents the socket 102 from electrically coupling to the plug. The socket 102 may therefore be for selectively coupling to the plug.

In other words, in example embodiments, the socket 102 may provide a form of "memory feature" where once the conforming portion 104 is in the first configuration, the socket 102 may only couple to or receive a certain plug or a certain group of (and not all) plugs, where the plug(s) has an identifier member (e.g., a recess) complementary to the conforming portion 104. This first configuration may remain unchanged and may therefore be retained due to the use of the securing member 106 which engages the at least part of the conforming portion 104, thereby preventing the conforming portion 104 from changing to the second (different) configuration. For example, the socket 102 may initially be used to receive or couple to this certain plug. By this initial coupling, the first configuration may be provided. The socket 102 in the first configuration may be subsequently used to receive or couple other plugs that are similar to this certain plug. If an unsuitable plug, which is not similar or not the same as this certain plug, is used, the socket 102 in the first configuration may be unable to receive or couple with the unsuitable plug. To allow the socket 102 to couple to a different plug, the securing member 106 disengages from the at least part of the conforming portion 104 so that the "memory feature" is reset or inactivated and the conforming portion 104 is no longer retained in the first configuration. This way, the conforming portion 104 may be changed to a different (new) configuration when receiving or coupling to the different plug and retain this different configuration until the securing member 106 is actively being disengaged from at least part of the conforming portion 104.

Figure 2A:
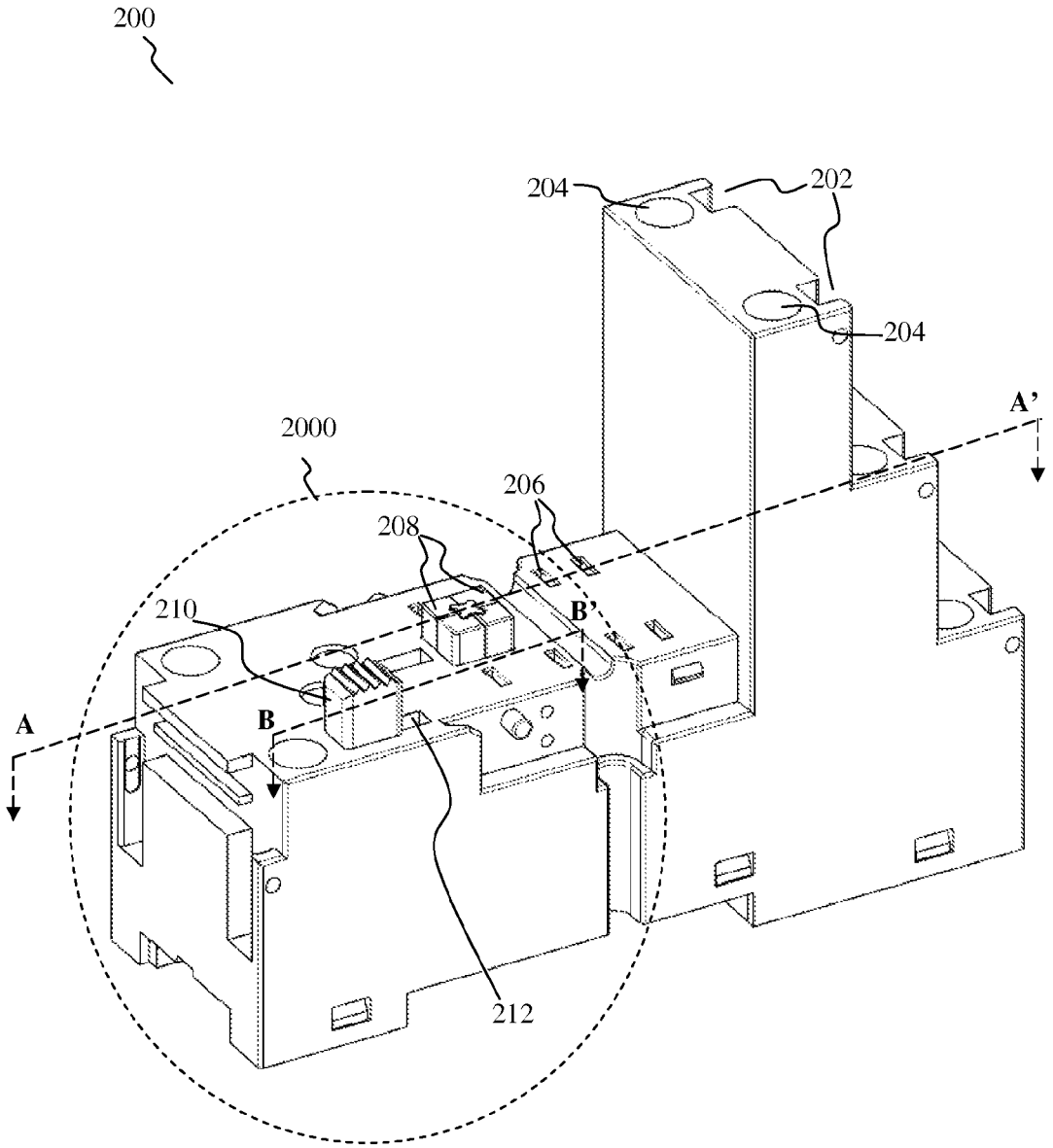
FIG. 2A is a perspective view of a schematic diagram of an exemplary socket, in accordance with various embodiments.

FIG. 2A shows an exemplary socket in a form of a relay socket 200. In FIG. 2A, the relay socket 200 includes contact points 202 to which wires leading to an external device (e.g., a power supply) (not shown) may be connected. The wires may be connected to the contact points 202 by screws 204 that may be adjustable to hold or clamp down the cables.

The relay socket 200 also includes electrical contacts 206 for receiving contact terminals of a relay plug (not shown). On the same surface of the electric contacts 206, a conforming portion (for example, the conforming portion 104 of FIG. 1) including a plurality of structural elements, each in a form of a pushbutton 208 is provided. A total of five pushbuttons 208 arranged with one pushbutton surrounded by four other pushbuttons is seen in the example of FIG. 2A. Each pushbutton 208 may have a shape and/or an orientation different from another pushbutton 208. It should be appreciated that any number of structural elements may be used so as long as the structural elements may be adjustable to form different configurations for the conforming portion. For example, the number of structural elements may be but is not limited to more than 1, more than 2, more than 3, more than 4, more than 5, more than 6, more than 7, more than 8, more than 9, or more than 10. It should also be appreciated and understood that the arrangement of the structural elements may take any order different from that as shown in FIG. 2A so as long as the arrangement attributes to forming different configurations for the conforming portion. For example, the structures elements may be but is not limited to being arranged in a single line, or along a curved line, or in a concentric formation. The number and arrangement of the structure elements may be dependent on a space available on a surface of the relay socket 200 to accommodate the conforming portion.

For example, the conforming portion may refer to a split button (e.g., the five pushbuttons 208 being arranged in a manner substantially resembling a single large button with splitted portions, each portion (i.e., each pushbutton 208) capable of being independently activated) that provides different configurations (or combinations) for different references (e.g. relays with various voltage ratings). This enables relays to be replaced by a correct reference, for example, during product replacement into the relay socket having a matching configuration. This mechanical foolproof relay socket may prevent the accidental use of incorrect or non-complementary relays (e.g., with incorrect operating coil voltage). The socket is equipped with a memory effect and is able to be used in compatibility with existing relay products.

Figure 2B:
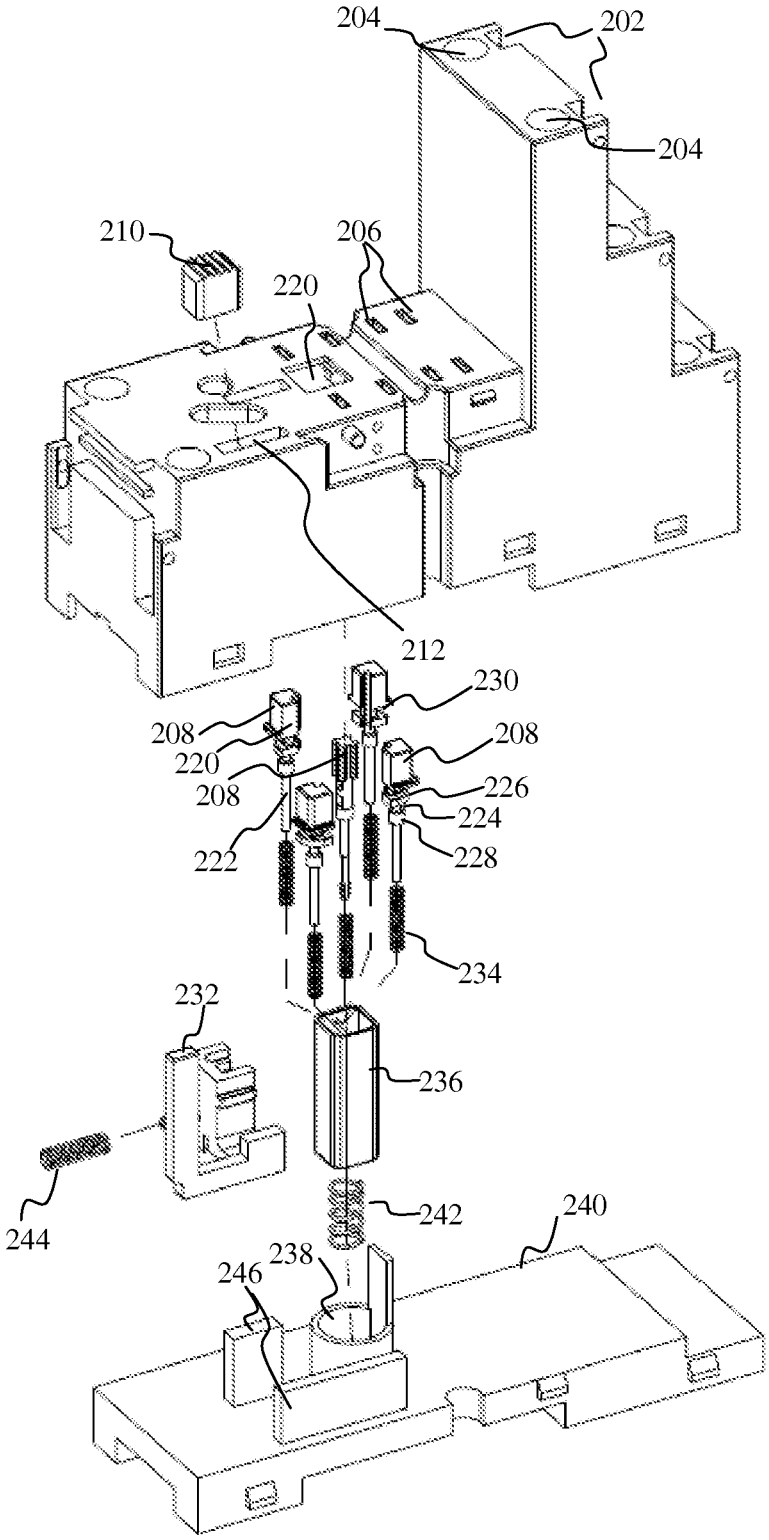
FIG. 2B is an exploded view of the schematic diagram of FIG. 2A, in accordance with various embodiments.

FIG. 2B shows an exploded view of the relay socket 200 (FIG. 2A). Each of the pushbuttons 208 includes a cap 220 and a body 222 extended from the cap 220. For example, the body 222 may be a post. Along the body 222, at least one detent 224 is formed between two rings 226, 228. Another detent 230 may be formed between the cap 220 and the ring 226. It should be appreciated that the at least one detent 224 and the other detent 230 may be formed by other ways, for example, having apertures or recesses along the body 222. The at least one detent 224 and/or the other detent 230 may be adapted to engage a securing member 232. Each of the pushbuttons 208 has a biasing member in the form of a spring 234 arranged to be coupled to the body 222. The spring 234 may provide a biasing force against the cap 220 such that each pushbutton 208 may include, for example, a spring-back pushbutton.

In FIG. 2B, the pushbuttons 208 are arranged within a sleeve 236 which is in turn received by a base support 238 formed on a base 240 of the relay socket 200. The cap 220 of each pushbutton is allowed to extend from the surface of the relay socket 200 through an opening 220. Another spring 242 is placed between the sleeve 236 and the base support 238. The other spring 242 may provide a biasing force against the sleeve 236. The securing member 232 is coupled to a reset spring 244 which works in cooperation with a resetting member 210. The securing member 232 is movable along the guides 246 in response to the resetting member 210 movable along the slot 212.

Figure 2C:
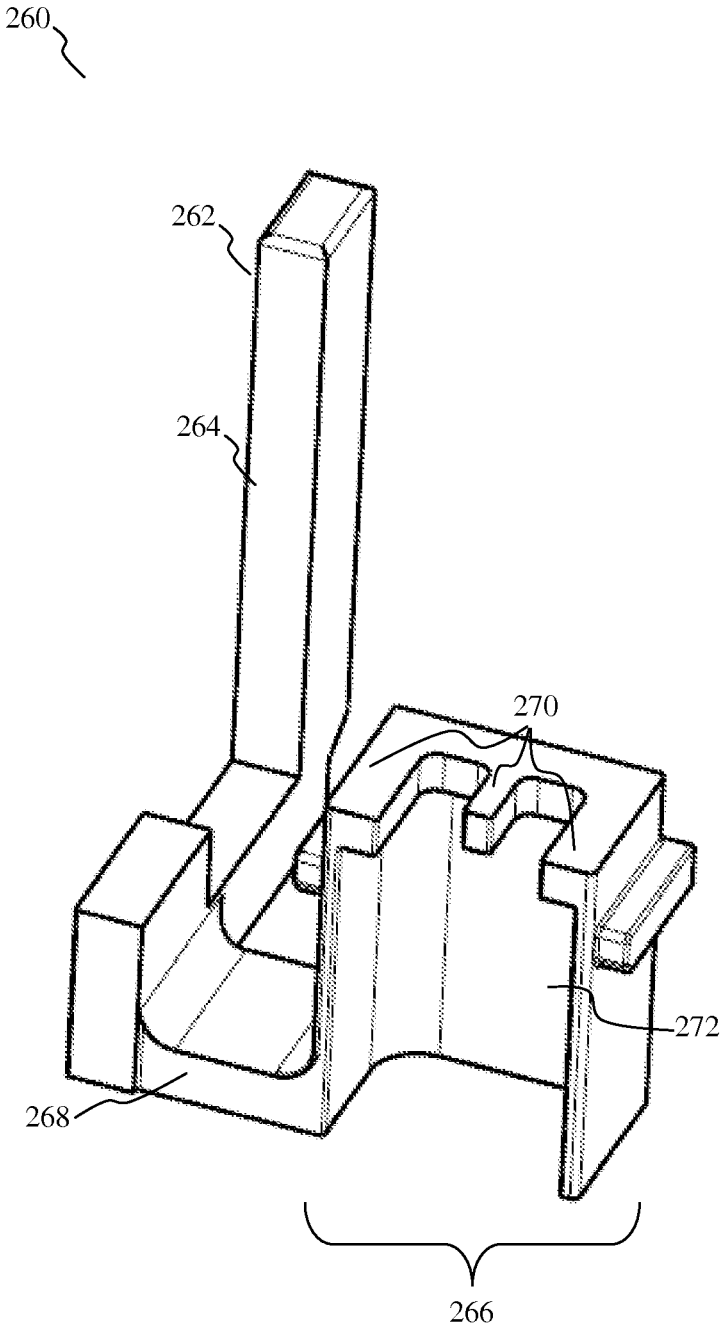
FIG. 2C is a front (left) perspective view of a schematic drawing of an exemplary securing member, in accordance with various embodiments.
Figure 2D:
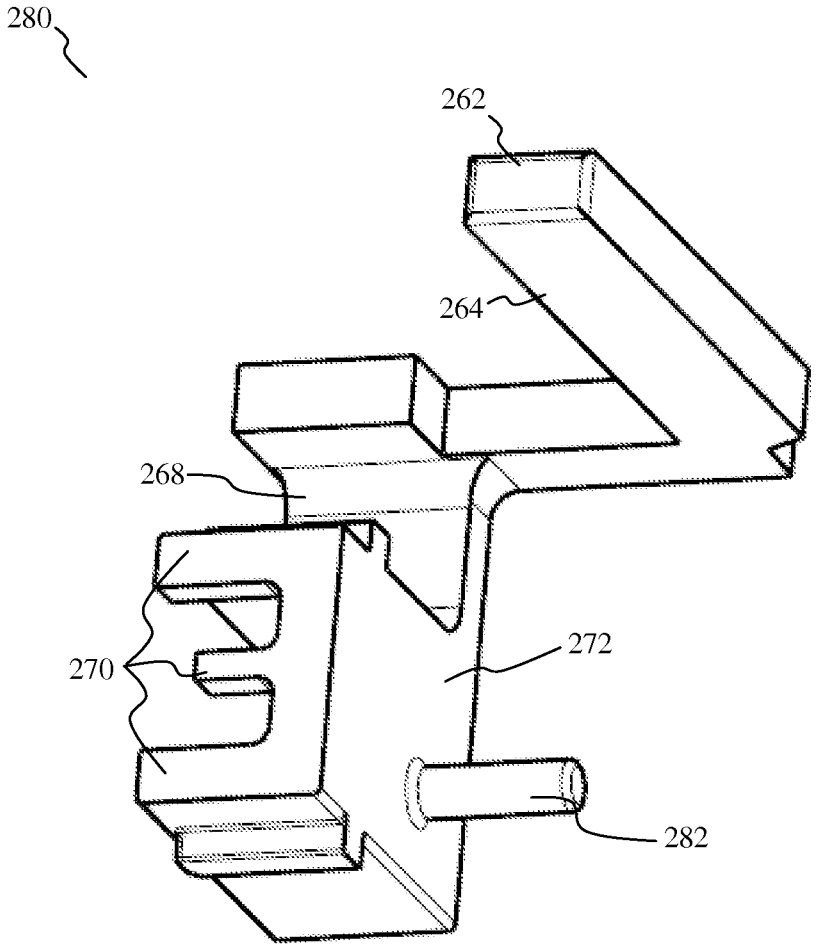
FIG. 2D is a side (right) perspective view of the exemplary securing member in FIG. 2C, in accordance with various embodiments.

FIGS. 2C and 2D show perspective views 260, 280 of an exemplary securing member 262 at different orientations.

The securing member 262 may be described in the context of the securing member 232 of FIG. 2B, or the securing member 106 of FIG. 1. The securing member 262 includes an elongate part 264 that is coupleable to a resetting member (not shown). The resetting member may be described in the context of the resetting member 210 (FIG. 2B). The elongate part 264 is coupled to an engaging part 266 via a linker 268. The linker 268 is placed on and glideable along a base of the socket (e.g., base 240 of the relay socket 200 (FIG. 2B)). The engaging part 266 includes arms 270 and an adjacent body 272.

An urging member 282 is extended from an outer surface of the body 272 as seen in FIG. 2D. The urging member 282 may be integrally formed with the body 272 or may be a separate part which is attached to the body 272.

It should be appreciated that apparent modifications can be made to the securing member 262 as seen in FIGS. 2C and 2D. It should also be understood that the securing member 262 may therefore take different forms and still achieve engagement with the pushbuttons (not shown). In various embodiments, the socket may include securing members, which may be of similar or different forms from one another to provide engagement with various pushbuttons. For example, each pushbutton may be associated with a dedicated securing member. In one example, the securing members may be ganged or simultaneously controlled. In another example, the securing members may be independently controlled. The securing member(s) may be located at different positions with respect to the pushbuttons.

As seen in FIG. 2A, with all five pushbuttons 208 extended, a squarish configuration of the conforming portion is formed. Collectively, with different pushbuttons being depressed with engagement of the securing member 232, different configurations or more specifically, different surface contours (or surface configurations) may be achieved. Further details will be described below with respect to the surface configuration and various mechanisms provided within the socket, for example, in FIG. 5 and FIGS. 6A to 6D, respectively.

Figure 3:
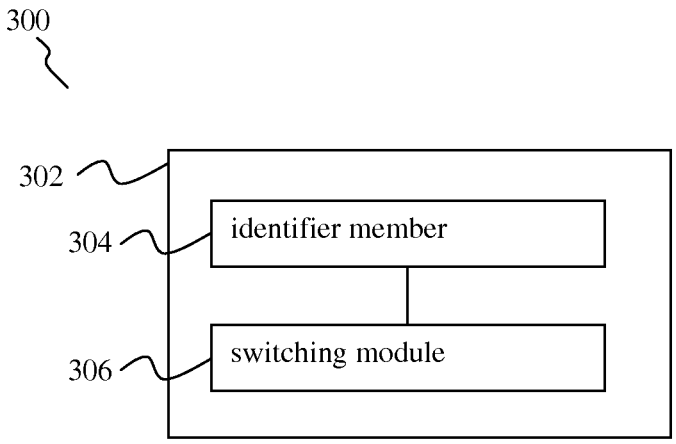
FIG. 3 is a block diagram of a plug, in accordance with various embodiments.

FIG. 3 shows a block diagram 300 of a plug 302 according to various embodiments. The plug 302 may be configured to cooperate with the socket (for example, the socket 102 of FIG. 1 or the relay socket 200 of FIG. 2A) as described herein. The relay plug 302 includes an identifier member 304 and a switching module 306.

The identifier member 304 is complementary to the first configuration of the socket such that the plug 302 is capable of electrically coupling to the socket (not shown in FIG. 3) when the conforming portion (for example, the conforming portion 104) of the socket is in the first configuration.

For example, the identifier member 304 may be in a form of a recess or a combination of predefined recesses on a surface of a relay plug. Different combinations of recesses may associate with different references (e.g., voltage ratings) of relay plugs. For example, the conforming portion (in the form of the pushbuttons 208 as seen in FIG. 2A) may be able to provide up to 14 different configurations and the relay socket 200 (FIG. 2A) adaptable to conform to any one of these 14 different configurations may be able to couple with up to 14 different relay plugs, each with a different identifier member. For example, during product replacement, the relay plug with the correct predefined identifier member can match and couple to the socket conformed to the matching configuration.

Figure 4A:
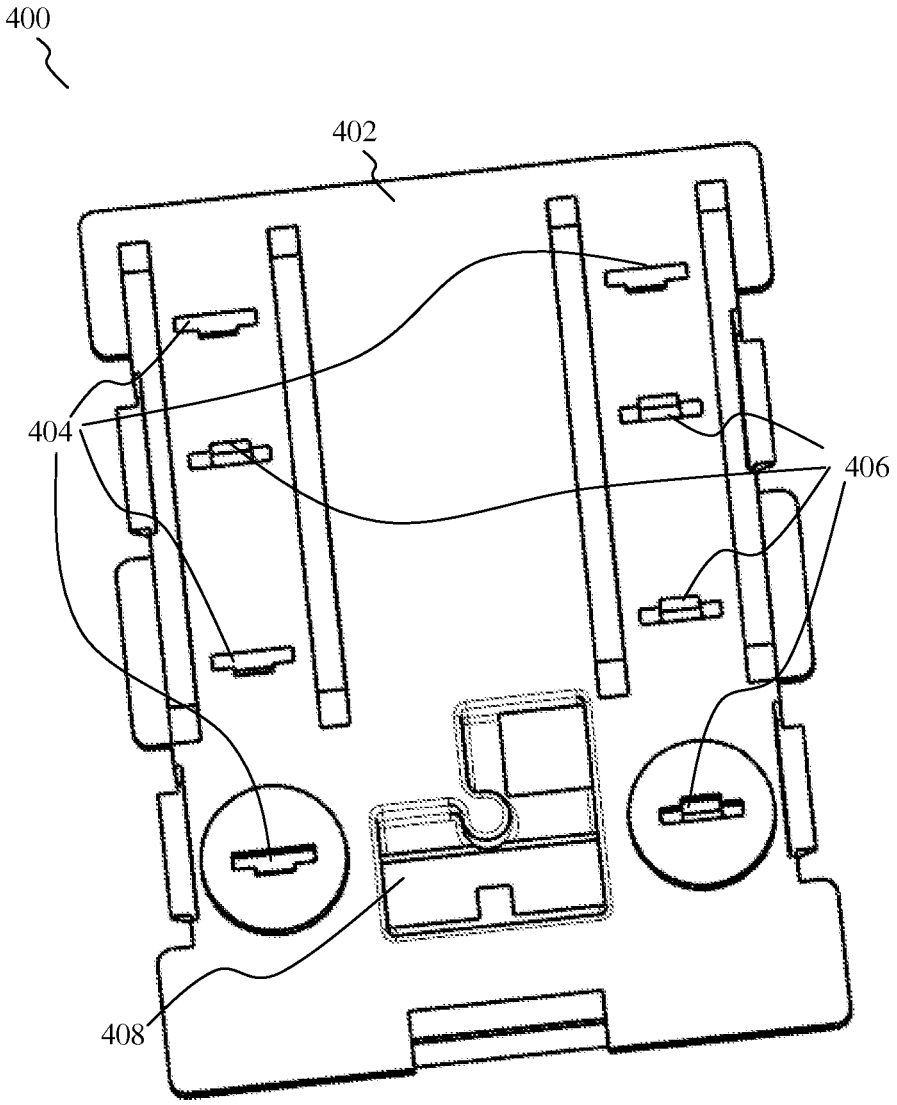
FIG. 4A is a bottom view of a schematic diagram of an exemplary plug, in accordance with various embodiments.
Figure 4B:
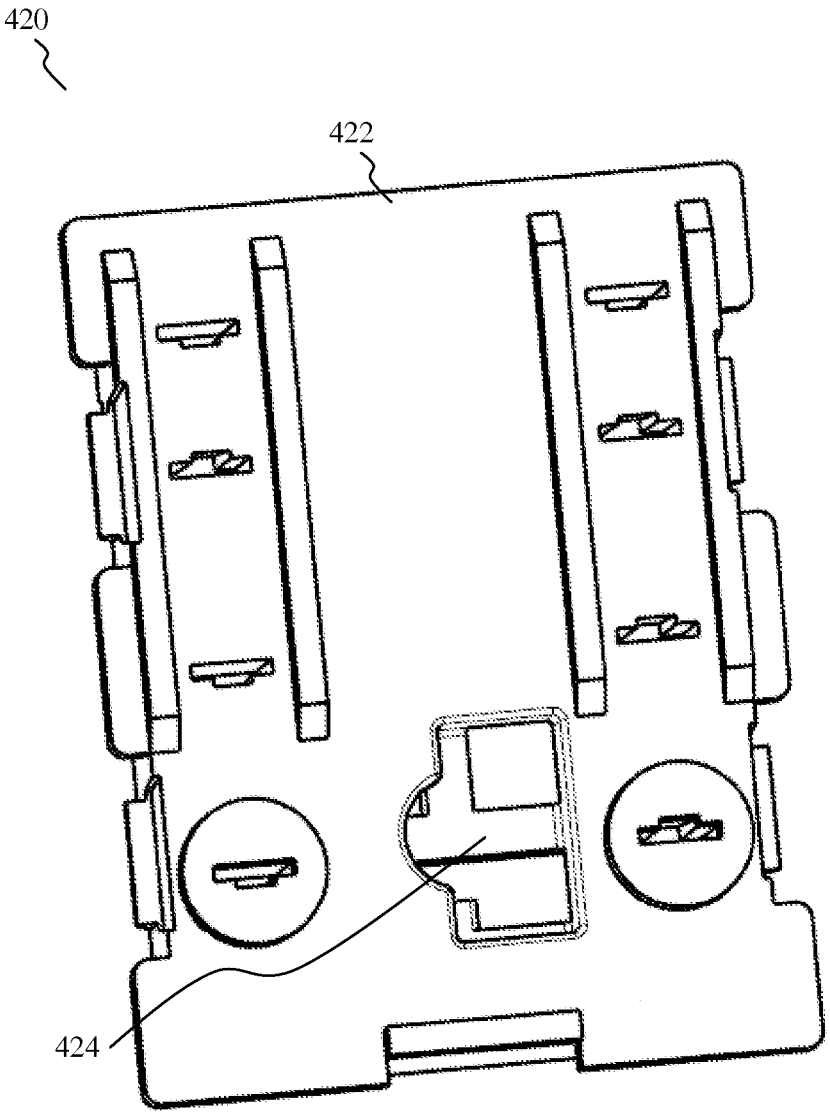
FIG. 4B is a bottom view of a schematic diagram of another exemplary plug, in accordance with various embodiments.
Figure 4C:
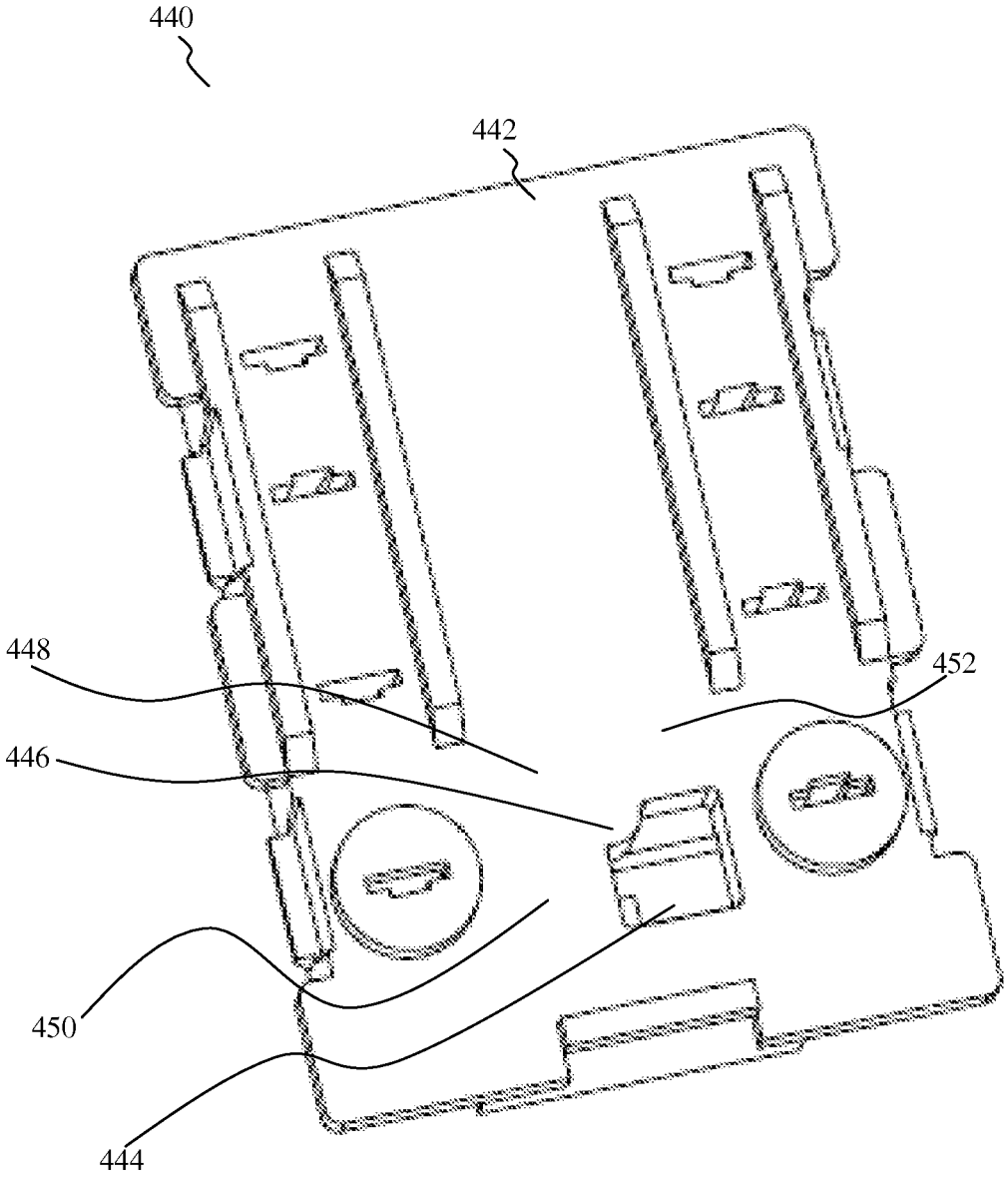
FIG. 4C is a bottom view of a schematic diagram of yet another exemplary plug, in accordance with various embodiments.

FIGS. 4A to 4C show bottom views of schematic diagrams 400, 420, 440 of example relay plugs 402, 422, 442.

In FIG. 4A, a relay plug 402 includes a plurality of terminal points 404 and contact terminals 406 extended from various terminal points 404. For example, the relay plug 402 has a total of four contact terminals 406 with one contact terminal 406 located on the second row towards the left side of the schematic diagram 400 and three remaining contact terminals 406 located on second row, third row and fourth row, all towards the right side of the schematic diagram 400. These contact terminals 406 may be connected to a switching module (not shown) that performs electric switching for an electric circuit. The relay plug 402 also includes an identifier member (for example, the identifier member 304 of FIG. 3) in a form of a shaped recess 408. The shaped recess 408 is of a substantially "L" shape which is complementary to a conforming portion with three surrounding pushbuttons (not shown in FIG. 4A) remaining extended in respective matching positions. In other words, a centre pushbutton and a surrounding pushbutton at a matching top left position of the shaped recess 408 are depressed.

FIG. 4B shows another relay plug 422 including an identifier member (for example, the identifier member 304 of FIG. 3) in a form of a shaped recess 424. The shaped recess 424 is of a shape which is complementary to a conforming portion with a centre pushbutton and two surrounding pushbuttons (not shown in FIG. 4B) remaining extended in respective matching positions. In other words, two other surrounding pushbuttons at matching top left and bottom left positions of the shaped recess 424 are depressed.

FIG. 4C shows yet another relay plug 442 including an identifier member (for example, the identifier member 304 of FIG. 3) in a form of a shaped recess 444. The shaped recess 444 is of a shape which is complementary to a conforming portion with one surrounding pushbutton (not shown in FIG. 4C) remaining extended in a respective matching position. In other words, a centre pushbutton at matching a centre position 446 and three other surrounding pushbuttons at matching top left 448, bottom left 450 and top right 452 positions of the shaped recess 424 are depressed. For example, the conforming portion may be in a configuration as seen in FIG. 5.

Figure 5:
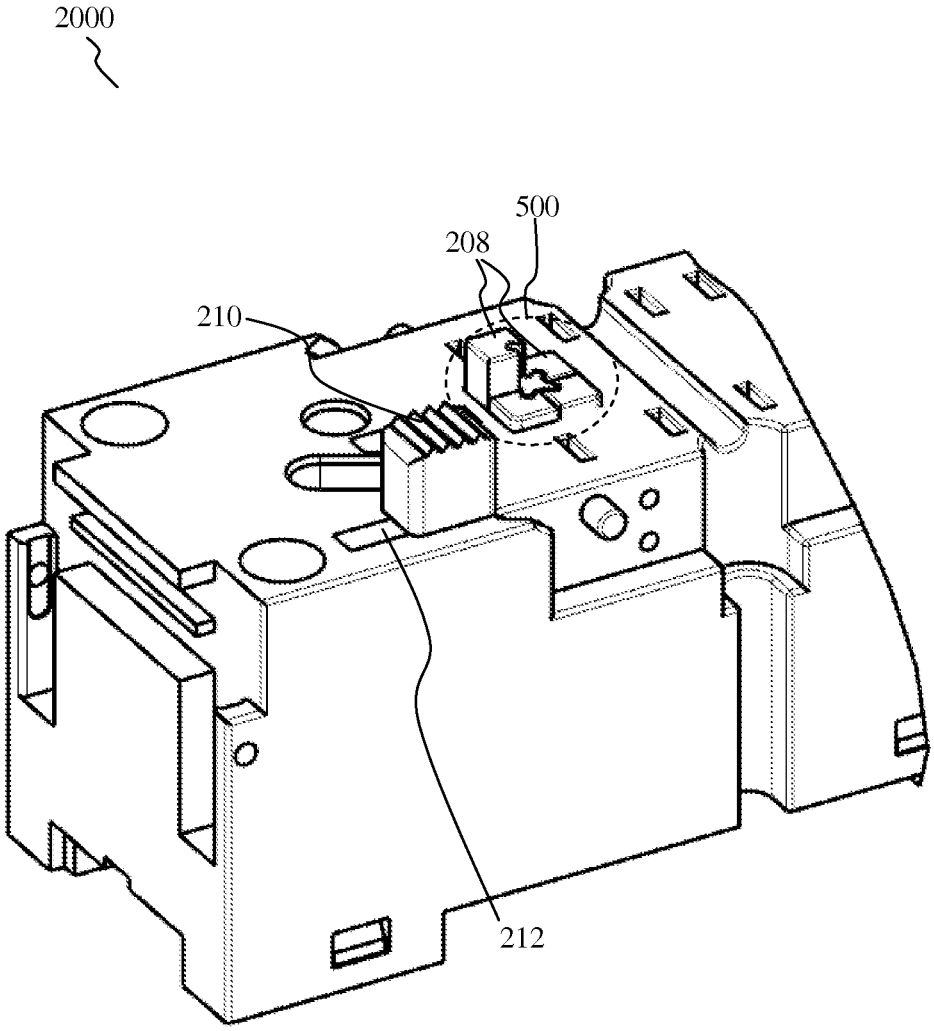
FIG. 5 is an expanded view of an encircled area 2000 of FIG. 2A, in accordance with various embodiments.

FIG. 5 shows an expanded perspective view of an encircled area 2000 of FIG. 2A. In FIG. 5, a conforming portion 500 is provided with one surrounding pushbutton 208 remaining extended while the remaining three surrounding pushbuttons and the centre pushbutton are depressed. The plurality of pushbuttons 208 enables a desired configuration (or a required combination) to be set according to an intended relay which has a voltage rating that matches a voltage rating configuration to an electric circuit that the socket is coupled to. The socket retains the set configuration (and therefore, for example, retains an indication of the voltage use) in order to mechanically prevent replacement by an incorrect or non-complementary relay (e.g., a relay with an inappropriate voltage rating). In FIG. 5, the conforming portion 500 with such a surface configuration enables the socket to be coupled to the relay plug 442 of FIG. 4C. For example, the extension of the pushbutton causes a protrusion which may prevent an incorrect or non-complementary relay plug with an inappropriate reference (e.g., voltage rating) as exemplified in FIG. 4A or 4B from being coupled to the socket.

For example, existing relay products typically are not provided with an identifier member, as those seen in FIGS. 4A to 4C. As such, to enable coupling to a correct existing relay product, the conforming portion in its entirety (i.e., all of the five pushbuttons 208) may be depressed so that no pushbuttons are extended from the surface of the socket to prevent coupling to the relay product. In other words, the conforming portion may not prevent or may not block the socket from coupling with the relay product.

In order to appreciate the mechanisms provided within the socket in accordance with various embodiments, the following description is with reference of cross-sectional side views of the socket (for example, the socket 102 of FIG. 1 and the relay socket 200 of FIG. 2A) as provided in FIGS. 6A to 6D.

Figure 6A:
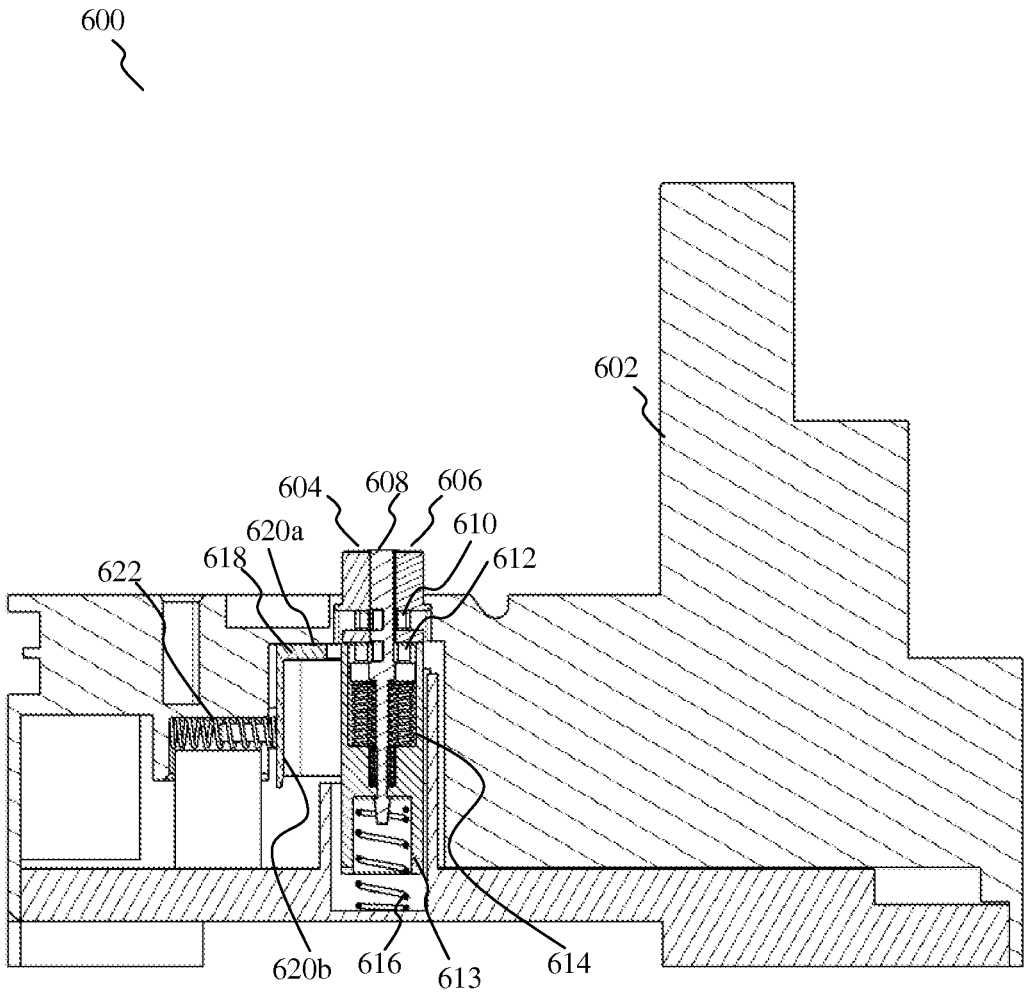
FIG. 6A is a cross-sectional side view as seen from line A-A' in FIG. 2A, in accordance with various embodiments.

FIG. 6A shows a cross-sectional side view 600 of the relay socket 602 according to various embodiments as seen from line A-A' of FIG. 2A. The relay socket 602 may be described in the context of the relay socket 200 of FIG. 2A. In FIG. 6A, a plurality of structural elements in form of pushbuttons 604, 606, 608 (two other pushbuttons are not shown in this cross-sectional view) is provided. At an initial or reset position, the pushbuttons 604, 606, 608 may be extended. Each of these pushbuttons 604, 606, 608 includes two rings 610, 612 which may be described in the context of the two rings 226, 228 of FIG. 2B. A biasing force is applied against each of these pushbuttons 604, 606, 608 by a spring 614 which may be described in the context of the spring 234 of FIG. 2B. Another spring 616 provides a biasing force against a sleeve 613 which accommodates the pushbuttons 604, 606, 608. The sleeve 613 may be described in the context of the sleeve 236 of FIG. 2B.

A securing member 618 is positioned on a side of the sleeve 613 and includes two parts 620*a*, 620*b* which forms an L-shaped structure. One end of part 620*a* is joined to one end of part 620*b* such that the two parts 620*a*, 620*b* are spaced apart at about 90 degrees from each other. The other (unjoint) end of part 620*a* is urged against the sleeve 613 containing pushbuttons 604, 606, 608 using a biasing force provided by a spring 622 to part 620*b*. At the initial or reset position, the securing member 618 may not be engaged with any of pushbuttons 604, 606, 608.

For example, the relay socket 602 in FIG. 6A may reflect a situation after performing a method of resetting the relay socket 602 as described herein.

Figure 6B:
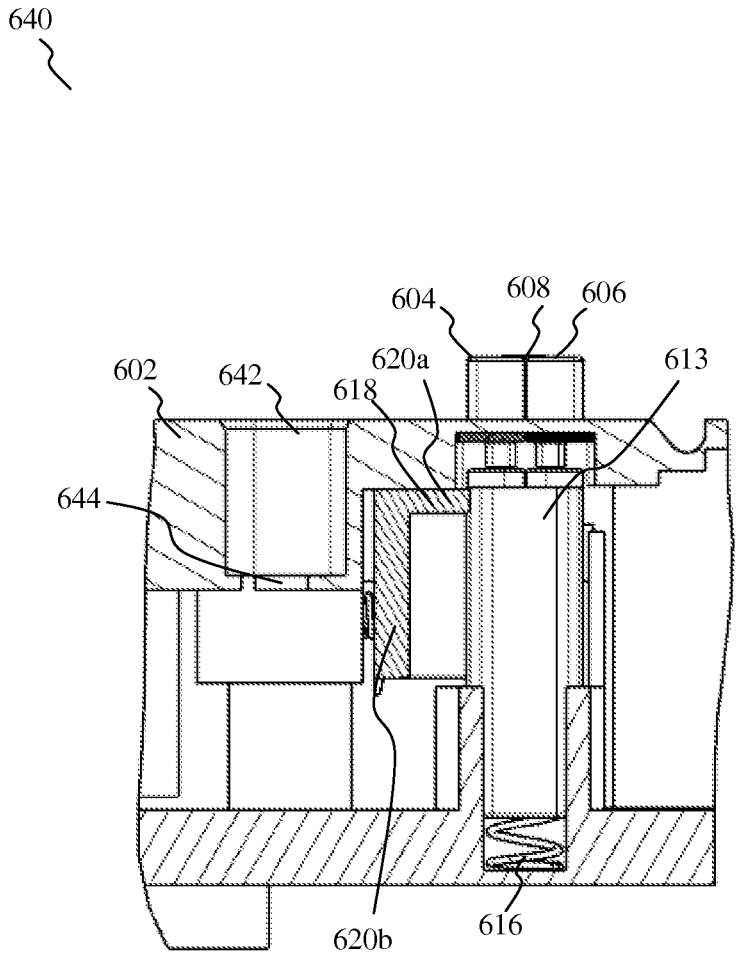
FIG. 6B is a partial cross-sectional side view as seen from line B-B' in FIG. 2A, in accordance with various embodiments.

FIG. 6B shows a partial cross-sectional side view 640 of the relay socket 602 according to various embodiments as seen from line B-B' of FIG. 2A. The relay socket 602 may be described in the context of the relay socket 200 of FIG. 2A. In FIG. 6B, at least part of a resetting member 642 is coupled to a third part 644 of the securing member 618 which integrally forms with the two parts 620*a*, 620*b*. The activation of the resetting member 642 brings the securing member 618 to a position as seen in FIG. 6A which reflects an unlocked position of the securing member 618.

Figure 6C:
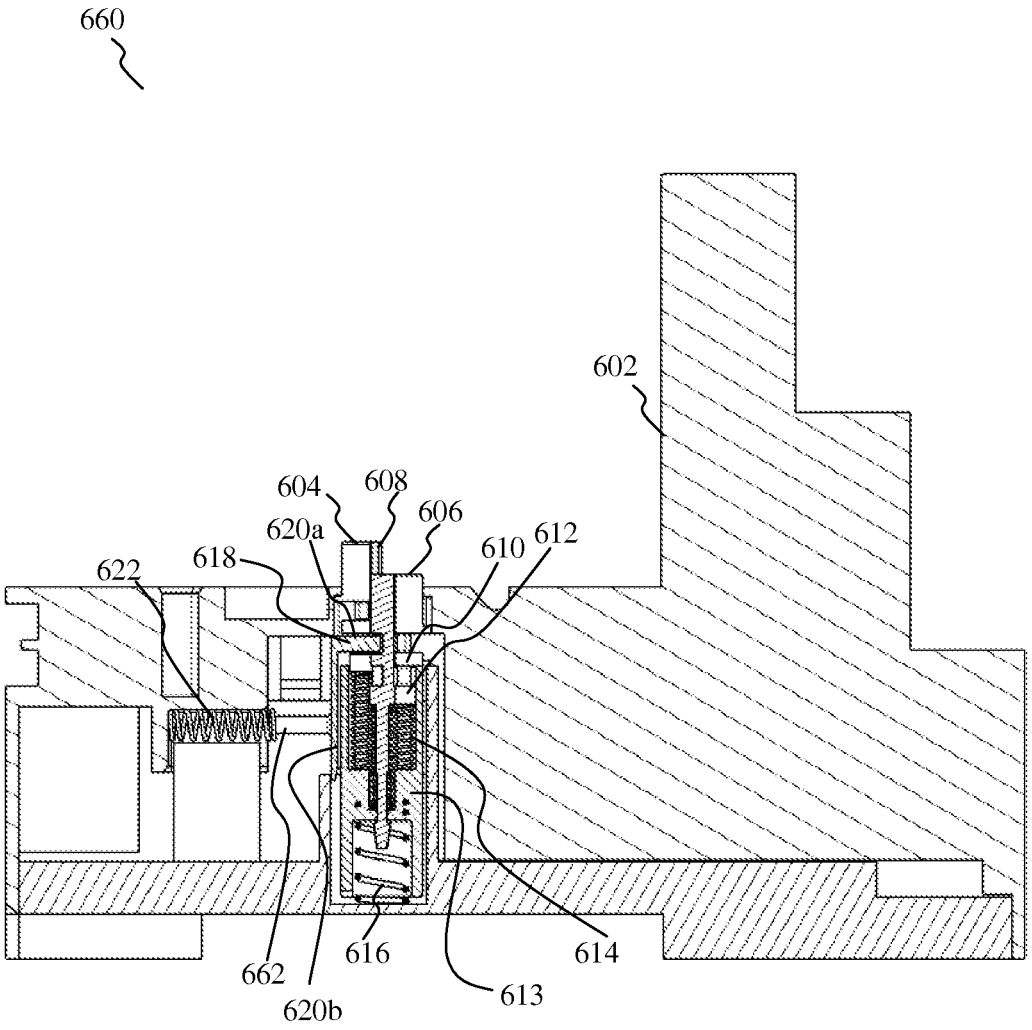
FIG. 6C is a cross-sectional side view as seen from line A-A' in FIG. 2A where a socket is set to a configuration, in accordance with various embodiments.

FIG. 6C shows a cross-sectional side view 660 of the relay socket 602 according to various embodiments as seen from line A-A' of FIG. 2A when the relay socket 602 is set to a configuration provided by the pushbuttons 604, 606, 608. Compared to FIG. 6C, FIG. 6A reflects the relay socket 602 after resetting from a configuration or before setting to a configuration.

In FIG. 6C, the configuration is provided by pushbutton 606 being depressed while pushbuttons 604, 608 remaining extended. With the depression of pushbutton 606, the securing member 618 is urged forward with an urging member 662 of part 620*b* being pushed by spring 622, resulting in that part 620*a* being engaged between respective rings 610, 212 of pushbuttons 604, 608, and between ring 610 and a head of pushbutton 606. This way, the pushbuttons 604, 606, 608 can no longer be adjusted as long as the securing member 618 engages with the pushbuttons 604, 606, 608. The urging member 662 works in co-operation with the spring 622 in biasing the securing member 618.

When pushbutton 606 is depressed (FIG. 6C) or if any pushbutton(s) is depressed, the sleeve 613 shifted at the same time (downwardly) as seen in FIG. 6C against the spring 616. This allows the sleeve 613 to no longer be in contact with part 620*a* and exposes pushbuttons 604, 606, 608 to part 620*a* for engagement therewith. In other words, for example, when the pushbutton 606 is depressed by a relay with no recess (i.e., an identifier member which is a flushed (flat) surface of the relay), the pushbutton 606 pushes the sleeve 613 downwardly (i.e., along the same direction as the depressing movement of the pushbutton 606) and allows the securing member 618 to move in and engage the pushbuttons 604, 606, 608 in position. This enables the pushbuttons 604, 606, 608 to be set at their respective positions according to the relay (in this case, with the identifier member which is a flushed (flat) surface of the relay).

Figure 6D:
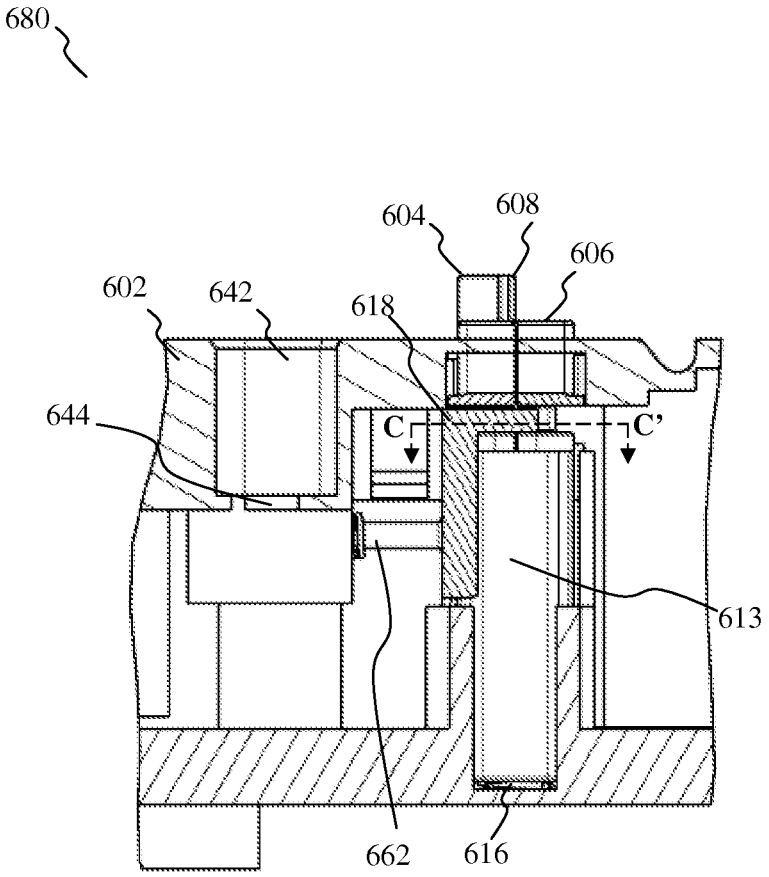
FIG. 6D is a partial cross-sectional side view as seen from line B-B' in FIG. 2A where a socket is set to the configuration denoted in FIG. 6C, in accordance with various embodiments.

FIG. 6D shows a partial cross-sectional side view 680 of the relay socket 602 according to various embodiments as seen from line B-B' of FIG. 2A when the relay socket 602 is set to the configuration seen in FIG. 6C. As described above, the activation of the resetting member 642 brings the securing member 618 to a position as seen in FIG. 6A, which reflects the unlocked position of the securing member 618. For example, the resetting member 642 may be used to reset the relay socket 602 when other relays (or relay plugs) or existing relays (or relay plugs) are used. By activating the resetting member 642, the securing member 618 moves out of a locked position and allow the pushbuttons 604, 608, 606 and the sleeve 613 to move upwardly to the original position, for example, as seen in FIG. 6A.

Figure 6E:
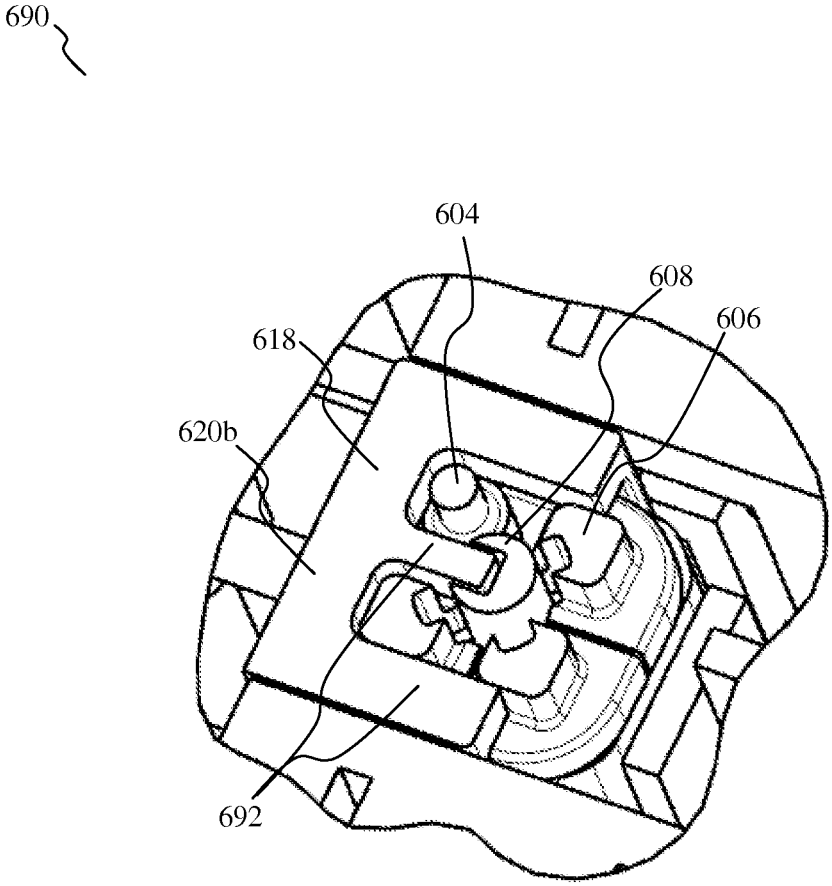
FIG. 6E is a partial perspective view as seen from line C-C' in FIG. 6D, in accordance with various embodiments.

FIG. 6E shows a partial perspective view 690 as seen from line C-C' in FIG. 6D. The securing member 618 includes arms 692 which engage pushbuttons 604, 608, 606 when the relay socket 602 is set to the configuration. The arms 692 may be described in the context of part 620*a* (FIGS. 6A to 6D) of the securing member 618.

Figure 7:
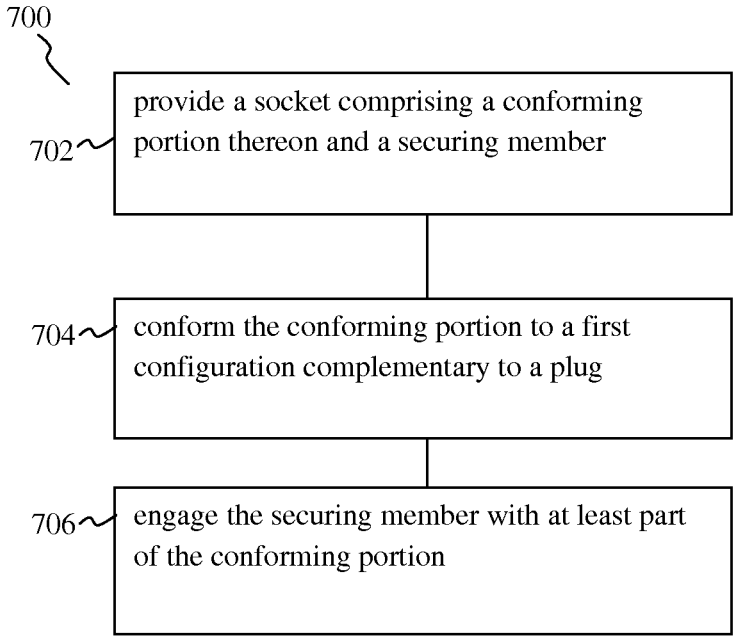
FIG. 7 is a flow diagram of a method of setting a socket, in accordance with various embodiments.

FIG. 7 shows a flow diagram 700 illustrating a method of setting a socket in accordance with various embodiments disclosed herein. At 702, a socket comprising a conforming portion thereon and a securing member are provided. At 704, the conforming portion is conformed to a first configuration complementary to a plug. At 706, the securing member engages at least part of the conforming portion. For example, the socket may be described in the context of the socket 102 of FIG. 1, or the relay socket 200 of FIGS. 2A and 2B, or the relay socket 602 of FIGS. 6A to 6E. The conforming portion may be described in the context of the conforming portion 104 of FIG. 1, and the securing member may be described in the context of the securing member 106 of FIG. 1, the securing member 232 of FIG. 2B, the securing member 262 of FIG. 2C or 2D, or the securing member 618 of FIGS. 6A to 6E. In one example, the first configuration may refer to the configuration provided by the pushbuttons 604, 606, 608 (FIGS. 6C and 6D). The method of setting the socket provides steps to be performed such that the socket may, for example, be set to at a state as shown in, but not limited to, FIGS. 6C and 6D.

In some embodiments, when the conforming portion of the socket is pre-engaged to the securing member, prior to the step of conforming the conforming portion at 704, a method of resetting the socket as will be described in FIG. 8 may be carried out first.

In other embodiments, when the conforming portion of the socket is not pre-engaged to the securing member, a method of resetting the socket as will be described in FIG. 8 may not be carried out prior to the step of conforming the conforming portion at 704.

Figure 8:
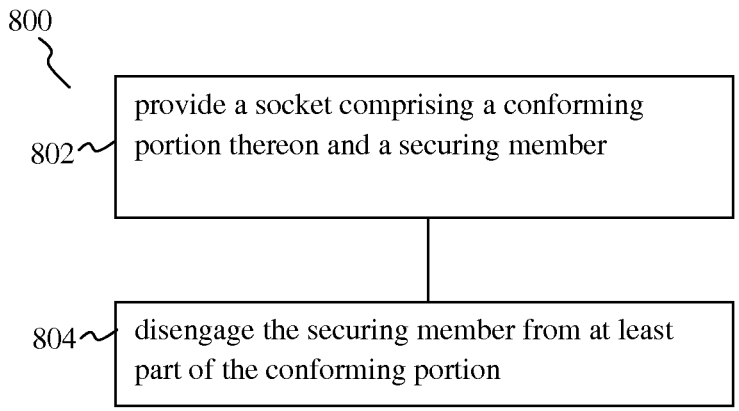
FIG. 8 is a flow diagram of a method of resetting a socket, in accordance with various embodiments.

FIG. 8 shows a flow diagram 800 illustrating a method of resetting a socket in accordance with various embodiments disclosed herein. At 802, a socket comprising a conforming portion thereon and a securing member are provided. At 804, the securing member disengages at least part of the conforming portion. For example, the socket may be described in the context of the socket 102 of FIG. 1, or the relay socket 200 of FIGS. 2A and 2B, or the relay socket 602 of FIGS. 6A to 6E. The conforming portion may be described in the context of the conforming portion 104 of FIG. 1, and the securing member may be described in the context of the securing member 106 of FIG. 1, the securing member 232 of FIG. 2B, the securing member 262 of FIG. 2C or 2D, the securing member 618 of FIGS. 6A to 6E. The method of resetting the socket provides steps to be performed such that the socket is reset to a state as shown in FIG. 6A.

In one example, the socket in the form of a relay socket may be configured in the following sequence:

The relay socket may be at reset condition initially where all split buttons (or pushbuttons) protrude without being compressed from the surface of the relay socket. The sleeve may be pushed up and maintained in position by a spring which blocks/stops the securing member to slide in and locks the split buttons.

Upon inserting the relay plug with the identifier member (or configuration recess), according to the voltage, onto the relay socket, the split buttons may be adjusted accordingly. The compressed split buttons may push the sleeve down and allow the securing member to slide in and lock all the split buttons in position (e.g., may be at the same or different level position(s)). This may form the configuration of the conforming portion which may reject the other relay plug with other configuration (voltage), when the initial relay is removed.

When intending to use other relays (or other relay plugs) with different voltage (another configuration), the relay socket may be reset by sliding the resetting button (which couples with the securing member) along the slot. The securing member may be brought away from the split buttons and hence all the split buttons and the sleeve move up. Then once again, the securing member may be blocked by the sleeve. The process repeats for inserting the other relay into the relay socket.

When a third party relay is used (with no identifier member), all the split buttons may be compressed and locked in position by the securing member.

Embodiments of the sockets, plugs, plug and socket assemblies, methods of setting sockets and methods of resetting sockets disclosed herein provide a simple yet effective measure of allowing selective coupling between a socket and a plug. Some example embodiments provided herein relate to relay sockets and relay plugs, however it should be understood and appreciated that such a measure may be applicable to other types of sockets, plugs, and socket and plug assemblies.

Advantageously, the use of an initial plug to set the socket to provide a configuration that allows only coupling to this initial plug or other plugs similar or the same as this initial plug provides users with a "memory feature" that is foolproof, easy, quick and accurate for identifying a suitable plug for the specific socket. This feature may be a poka yoke feature for the socket. This way, the users may not need to refer to any coding references (such as colour codings) for identifying the suitable plug which may be time-consuming or not user-friendly especially when the coding references are not readily available or are not in a standardized form. The effect of using the sockets, plugs and socket and plug assemblies having a memory feature as disclosed herein may be immediate and consequently, the possibility of a plug and socket mismatch may be significantly reduced, thereby also reducing the likelihood of circuit malfunction or overloading. The versatility of the sockets and plugs disclosed herein can provide users a favorable and attractive alternative to existing plugs and sockets.

It will be appreciated by a person skilled in the art that other variations and/or modifications may be made to the embodiments disclosed herein without departing from the spirit or scope of the disclosure as broadly described. The present embodiments are, therefore, to be considered in all respects to be illustrative and not restrictive.

What is claimed is:

1. A socket for selectively coupling to a plug, the socket comprising:

a conforming portion adapted to conform to a first configuration complementary to the plug, wherein the first configuration allows the socket to electrically couple to the plug; and a securing member adjustable to releasably engage at least part of the conforming portion to substantially prevent the conforming portion from changing to a second configuration different from the first configuration, wherein the second configuration substantially prevents the socket from electrically coupling to the plug.

2. The socket of claim 1, wherein the conforming portion is adapted to conform to the first configuration upon coupling with the plug, and wherein the socket comprises a memory feature whereby the securing member engages at least part of the conforming portion so that the conforming portion retains the first configuration upon decoupling of the plug.

3. The socket of claim 1, wherein the conforming portion is electrically non-conductive, wherein the first configuration is complementary to a first identifier member disposed on the plug, and wherein the first configuration comprises a configuration that is complementary to at least one of a structure or an orientation of the first identifier member.

4. The socket of claim 3, wherein the second configuration is complementary to a second identifier member disposed on a different plug, the first and second identifier members having at least one characteristic that is different from each other, wherein the second configuration comprises a configuration complementary to at least one of a structure or an orientation of the second identifier member, and wherein the first identifier member is associated with a first voltage rating configuration that is different from a second voltage rating configuration associated with the second identifier member.

5. The socket of claim 4, wherein the securing member is configured to move between a locked position and an unlocked position, wherein in the locked position, the securing member engages the at least part of the conforming portion; and wherein in the unlocked position, the securing member is substantially free from being engaged with the at least part of the conforming portion.

6. The socket of claim 5, further comprising a guide for guiding the movement of the securing member between the locked position and the unlocked position, and a biasing member arranged to bias the securing member against the conforming portion, wherein the biasing member comprises a spring.

7. The socket of claim 6, wherein the conforming portion comprises a plurality of structural elements independently movable with respect to each other for allowing the conforming portion to conform to the first configuration, wherein the first configuration comprises a surface configuration of the socket defined by the conforming portion, and wherein each of the plurality of structural elements comprises an elongated member.

8. The socket of claim 7, wherein at least one of the plurality of structural elements coupled to a returning member for returning the structural element to a resting position when the securing member is substantially disengaged from the conforming portion, wherein the resting position comprises a position where the structural element extends from a surface of the socket, and wherein the securing member is adjustable to engage at least one of the plurality of structural elements.

9. The socket of claim 8, wherein the at least one of the plurality of structural elements comprises at least one detent configured to cooperate with the securing member, wherein the securing member comprises at least one projection; and wherein the at least one detent is arranged to receive the at least one projection such that the at least one of the plurality of structural elements is prevented from being movable.

10. The socket of claim 9, further comprising a resetting member coupled to the securing member, wherein the resetting member is operable to release engagement of the securing member with the at least part of the conforming portion to allow the conforming portion to be free to conform to a new configuration.

11. The socket of claim 1, wherein the socket is a relay socket, wherein the plug us a relay plug, and wherein the conforming portion is disposed on a housing of the socket.

12. The socket of claim 1, wherein the conforming portion in the first configuration is associated with a voltage rating configuration of the plug, and wherein the conforming portion is incompatible to couple to another plug having a different voltage rating configuration.

13. An assembly comprising:

a plug;

a socket for selectively coupling to the plug, the socket comprising:

a conforming portion adapted to conform to a first configuration complementary to the plug, wherein the first configuration allows the socket to electrically couple to the plug; and a securing member adjustable to releasably engage at least part of the conforming portion to substantially prevent the conforming portion from changing to a second configuration different from the first configuration, wherein the second configuration substantially prevents the socket from electrically coupling to the plug; and wherein the plug is configured to cooperate with the socket, the plug comprising an identifier member that is complementary to the first configuration of the socket such that the plug is capable of electrically coupling to the socket when the conforming portion of the socket is in the first configuration.

14. The assembly of claim 13, wherein the conforming portion is adapted to conform to the first configuration upon coupling with the plug, and wherein the socket comprises a memory feature whereby the securing member engages at least part of the conforming portion so that the conforming portion retains the first configuration upon decoupling of the plug.

15. The assembly of claim 13, wherein the identifier member is capable of adapting the conforming portion of the socket to conform to the first configuration.

16. The assembly of claim 13, further comprising a switching module configured to perform electrical switching for an electric circuit.

17. The assembly of claim 13, wherein the first configuration is complementary to a first identifier member disposed on the plug, wherein the first configuration comprises a configuration that is complementary to at least one of a structure or an orientation of the first identifier member, and wherein the second configuration is complementary to a second identifier member disposed on a different plug, the first and second identifier members having at least one characteristic that is different from each other.

18. A method of setting a socket for selectively coupling to a plug, the method comprising:

providing the socket comprising:

a conforming portion thereon, the conforming portion capable of conforming to a first configuration complementary to the plug; and a securing member adjustable to releasably engage at least part of the conforming portion;

conforming the conforming portion to the first configuration complementary to the plug wherein the first configuration allows the socket to electrically couple to the plug; and engaging the securing member with the at least part of the conforming portion to substantially prevent the conforming portion from changing to a second configuration different from the first configuration, wherein the second configuration substantially prevents the socket from electrically coupling to the plug.

19. The method of claim 18, wherein the step of conforming the conforming portion to the first configuration comprises coupling the socket with the plug.

20. The method of claim 19, wherein the step of engaging the securing member comprises moving the securing member from an unlocked position to a locked position, wherein in the locked position, the securing member engages the at least part of the conforming portion and wherein in the unlocked position, the securing member is substantially free from being engaged with the at least part of the conforming portion.

21. The method of claim 20, wherein the conforming portion comprises a plurality of structural elements independently movable with respect to each other for allowing the conforming portion to conform to the first configuration.

22. The method of claim 21, wherein the step of engaging the securing member to the at least part of the conforming portion comprises receiving at least one projection of the securing member in at least one detent disposed on at least one of the plurality of structural elements such that the at least one of the plurality of structural elements is substantially prevented from moving with respect to another structural element.

23. The method of claim 19, further comprising a step of disengaging the securing member from the at least part of the conforming portion such that the conforming portion is no longer prevented from changing to the second configuration, wherein the step of disengaging the securing member from the at least part of the conforming portion is carried out when a plug is not coupled to the socket.

* * * * *